US010167690B2

(12) United States Patent
Haq et al.

(10) Patent No.: US 10,167,690 B2
(45) Date of Patent: Jan. 1, 2019

(54) CUTTER ASSEMBLY FOR CUTTING A TUBULAR

(71) Applicant: Weatherford Technology Holdings, LLC, Houston, TX (US)

(72) Inventors: Mohammed Aleemul Haq, Houston, TX (US); Richard J. Segura, Cypress, TX (US); David W. Teale, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 260 days.

(21) Appl. No.: 15/167,274

(22) Filed: May 27, 2016

(65) Prior Publication Data

US 2016/0348455 A1 Dec. 1, 2016

Related U.S. Application Data

(60) Provisional application No. 62/167,410, filed on May 28, 2015.

(51) Int. Cl.

| | |
|---|---|
| ***E21B 29/00*** | (2006.01) |
| ***E21B 29/06*** | (2006.01) |
| ***E21B 17/10*** | (2006.01) |

(52) U.S. Cl.

CPC ..... *E21B 29/005* (2013.01); *E21B 17/1078* (2013.01); *E21B 29/06* (2013.01)

(58) Field of Classification Search

CPC ..... E21B 29/005; E21B 29/06; E21B 17/1078

See application file for complete search history.

(56) References Cited

U.S. PATENT DOCUMENTS

| | | | |
|---|---|---|---|
| 1,867,289 | A | 7/1932 | Ventresca |
| 2,481,637 | A | 9/1949 | Yancey |

(Continued)

FOREIGN PATENT DOCUMENTS

| | | | |
|---|---|---|---|
| EP | 0916803 | A2 | 5/1999 |
| GB | 2262711 | A | 6/1993 |

(Continued)

OTHER PUBLICATIONS

Trahan et al., "One-trip casing exit milling saves time during complex drilling," Offshore Magazine, Apr. 9, 2014, vol. 74, Issue 4, pp. 82-85.

(Continued)

*Primary Examiner* — Brad Harcourt

(74) *Attorney, Agent, or Firm* — Patterson & Sheridan, L.L.P.

(57) ABSTRACT

A method of cutting a tubular includes disposing a rotatable cutter assembly in the tubular, the cutter assembly including a blade having a cutting portion; engaging the tubular using a trailing cutting structure of the cutting portion; engaging the tubular using an intermediate cutting structure of the cutting portion; forming a window in the tubular; and longitudinally extending the window using a leading cutting structure of the cutting portion. A rotatable blade includes a blade body extendable from a retracted position; and a cutting portion on the blade body having: a trailing cutting structure configured to engage the tubular, an intermediate cutting structure configured to engage the tubular while the trailing cutting structure engages the tubular, a leading cutting structure configured to engage an exposed wall thickness of the tubular; and an integral stabilizer disposed on at least a portion of an outer surface of the blade body.

22 Claims, 22 Drawing Sheets

(56) References Cited

U.S. PATENT DOCUMENTS

| | | | | |
|---|---|---|---|---|
| 2,735,485 | A | 2/1956 | Metcalf, Jr. | |
| 2,761,196 | A | 9/1956 | Graves et al. | |
| 2,846,193 | A * | 8/1958 | Chadderdon | E21B 29/00 166/55.7 |
| 2,899,000 | A | 8/1959 | Medders et al. | |
| 3,110,084 | A | 11/1963 | Kinzbach | |
| 3,396,795 | A * | 8/1968 | Venghiattis | B23D 21/14 166/217 |
| 3,419,077 | A | 12/1968 | Sanford | |
| 4,431,065 | A | 2/1984 | Andrews | |
| 4,565,252 | A | 1/1986 | Campbell et al. | |
| 4,710,074 | A | 12/1987 | Springer | |
| 4,889,197 | A | 12/1989 | Boe | |
| 4,938,291 | A | 7/1990 | Lynde et al. | |
| 5,035,293 | A | 7/1991 | Rives | |
| 5,036,921 | A | 8/1991 | Pittard et al. | |
| 5,058,666 | A * | 10/1991 | Lynde | E21B 10/46 166/55.6 |
| 5,060,738 | A | 10/1991 | Pittard et al. | |
| 5,074,355 | A | 12/1991 | Lennon | |
| 5,318,137 | A | 6/1994 | Johnson et al. | |
| 5,318,138 | A | 6/1994 | Dewey et al. | |
| 5,373,900 | A | 12/1994 | Lynde et al. | |
| 5,392,858 | A | 2/1995 | Peters et al. | |
| 5,447,207 | A | 9/1995 | Jones | |
| 5,532,048 | A | 7/1996 | Klocek et al. | |
| 5,582,260 | A | 12/1996 | Murer et al. | |
| 5,620,051 | A | 4/1997 | Carter et al. | |
| 5,771,942 | A | 6/1998 | Bunger | |
| 5,771,972 | A | 6/1998 | Dewey et al. | |
| 5,887,668 | A | 3/1999 | Haugen et al. | |
| 5,899,268 | A | 5/1999 | Lynde et al. | |
| 5,979,571 | A | 11/1999 | Scott et al. | |
| 6,009,961 | A | 1/2000 | Pietrobelli et al. | |
| 6,125,929 | A | 10/2000 | Davis et al. | |
| 6,155,349 | A | 12/2000 | Robertson et al. | |
| 6,202,752 | B1 | 3/2001 | Kuck et al. | |
| 6,206,111 | B1 | 3/2001 | Nistor | |
| 6,357,528 | B1 | 3/2002 | Davis et al. | |
| 6,401,821 | B1 | 6/2002 | Kennedy et al. | |
| 6,568,492 | B2 | 5/2003 | Thigpen et al. | |
| 6,612,383 | B2 | 9/2003 | Desai et al. | |
| 6,679,328 | B2 | 1/2004 | Davis et al. | |
| 6,732,817 | B2 | 5/2004 | Dewey et al. | |
| 6,920,923 | B1 | 7/2005 | Pietrobelli et al. | |
| 7,143,848 | B2 | 12/2006 | Armell | |
| 7,178,609 | B2 | 2/2007 | Hart et al. | |
| 7,314,099 | B2 | 1/2008 | Dewey et al. | |
| 7,624,818 | B2 | 12/2009 | McClain et al. | |
| 7,909,100 | B2 | 3/2011 | Bryant, Jr. et al. | |
| 7,954,570 | B2 | 6/2011 | McClain et al. | |
| 8,082,988 | B2 | 12/2011 | Redlinger et al. | |
| 8,540,035 | B2 | 9/2013 | Xu et al. | |
| 8,555,955 | B2 | 10/2013 | Davis | |
| 9,022,117 | B2 | 5/2015 | Segura et al. | |
| 2002/0144815 | A1 | 10/2002 | Van Drentham-Susman et al. | |
| 2004/0245020 | A1 | 12/2004 | Giroux et al. | |
| 2005/0039905 | A1 | 2/2005 | Hart et al. | |
| 2008/0115972 | A1 | 5/2008 | Lynde et al. | |
| 2008/0169107 | A1 | 7/2008 | Redlinger et al. | |
| 2009/0266544 | A1 | 10/2009 | Redlinger et al. | |
| 2010/0006290 | A1 | 1/2010 | Saylor, III et al. | |
| 2010/0065264 | A1 | 3/2010 | Nackerud | |
| 2011/0220357 | A1 | 9/2011 | Segura et al. | |
| 2011/0278064 | A1 | 11/2011 | Rasheed | |
| 2012/0152543 | A1 | 6/2012 | Davis | |
| 2012/0186823 | A1 | 7/2012 | Xu | |
| 2012/0325480 | A1 | 12/2012 | Schmidt et al. | |
| 2015/0101812 | A1 | 4/2015 | Bansal et al. | |
| 2015/0275606 | A1 | 10/2015 | Segura et al. | |
| 2016/0130899 | A1 * | 5/2016 | Cronley | E21B 29/005 166/298 |

FOREIGN PATENT DOCUMENTS

| | | | |
|---|---|---|---|
| GB | 2352747 | A | 2/2001 |
| GB | 2420359 | A | 5/2006 |
| GB | 2486898 | A | 7/2012 |
| WO | 9319281 | A1 | 9/1993 |
| WO | 07/11250 | A1 | 1/2007 |
| WO | 2014150524 | A2 | 9/2014 |

OTHER PUBLICATIONS

PCT International Search Report and Written Opinion dated Oct. 25, 2016, for International Application No. PCT/US2016/034744.

* cited by examiner

CUTTER ASSEMBLY FOR CUTTING A TUBULAR

BACKGROUND OF THE INVENTION

Field of the Invention

The present disclosure generally relates to a cutter assembly for cutting a tubular in a wellbore.

Description of the Related Art

A wellbore is formed to access hydrocarbon bearing formations, for example crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

From time to time, for example once the hydrocarbon-bearing formations have been depleted, the wellbore must be plugged and abandoned (P&A) using cement plugs. This P&A procedure seals the wellbore from the environment, thereby preventing wellbore fluid, such as hydrocarbons and/or salt water, from polluting the surface environment. This procedure also seals sensitive formations, such as aquifers, traversed by the wellbore from contamination by the hydrocarbon-bearing formations. Setting of a cement plug when there are two adjacent casing strings lining the wellbore is presently done by cutting a window in each of the adjacent casing strings and squeezing cement into the windows to provide a satisfactory seal. A tool designed to cut through casing requires different cutter properties than a tool designed to section mill a casing. It would be advantageous to combine the different attributes onto a single tool.

There is a need for a more effective apparatus and method of cutting casing/liner in the wellbore.

SUMMARY OF THE INVENTION

A method of cutting a tubular includes disposing a rotatable cutter assembly in the tubular, the cutter assembly including a blade having a cutting portion; engaging the tubular using a trailing cutting structure of the cutting portion; engaging the tubular using an intermediate cutting structure of the cutting portion; forming a window in the tubular; and longitudinally extending the window using a leading cutting structure of the cutting portion.

A rotatable blade for cutting a tubular includes a blade body extendable from a retracted position; and a cutting portion on the blade body having: a trailing cutting structure configured to engage the tubular, an intermediate cutting structure configured to engage the tubular while the trailing cutting structure engages the tubular, a leading cutting structure configured to engage an exposed wall thickness of the tubular; and an integral stabilizer disposed on at least a portion of an outer surface of the blade body.

A bottom hole assembly for cutting a tubular includes a cutter assembly; and a stabilizer assembly including: a housing that is rotatable relative to the tubular; a stabilizer blade having an eccentric extension path relative to the housing; and an actuation mechanism for extending the stabilizer blade from a retracted position to an extended position, wherein the stabilizer blade in the extended position engages an inner wall of the tubular without cutting the tubular.

A method of cutting a tubular includes disposing a rotatable cutter assembly in the tubular, the cutter assembly including a first stabilization surface; disposing a rotatable stabilizer assembly in the tubular, the stabilizer assembly including a second stabilization surface; and engaging the tubular with the first and second stabilization surfaces.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore. "Axial" and similar terms refer to a direction along the longitudinal axis of a wellbore, tubular, or generally cylindrically symmetric tool disposed in a wellbore or tubular. "Lateral" and similar terms refer to a direction on a plane perpendicular to axial. "Cutting a tubular" indicates cutting in any fashion that removes material from the tubular in the proximity of the cut, including, for example, milling, grinding, machining, turning, chipping, boring, plaining, and shaving. "Cutting through" a tubular implies making a full-thickness removal of material, while "cutting" includes both full-thickness cuts and partial-thickness removal of material.

Figure 1:
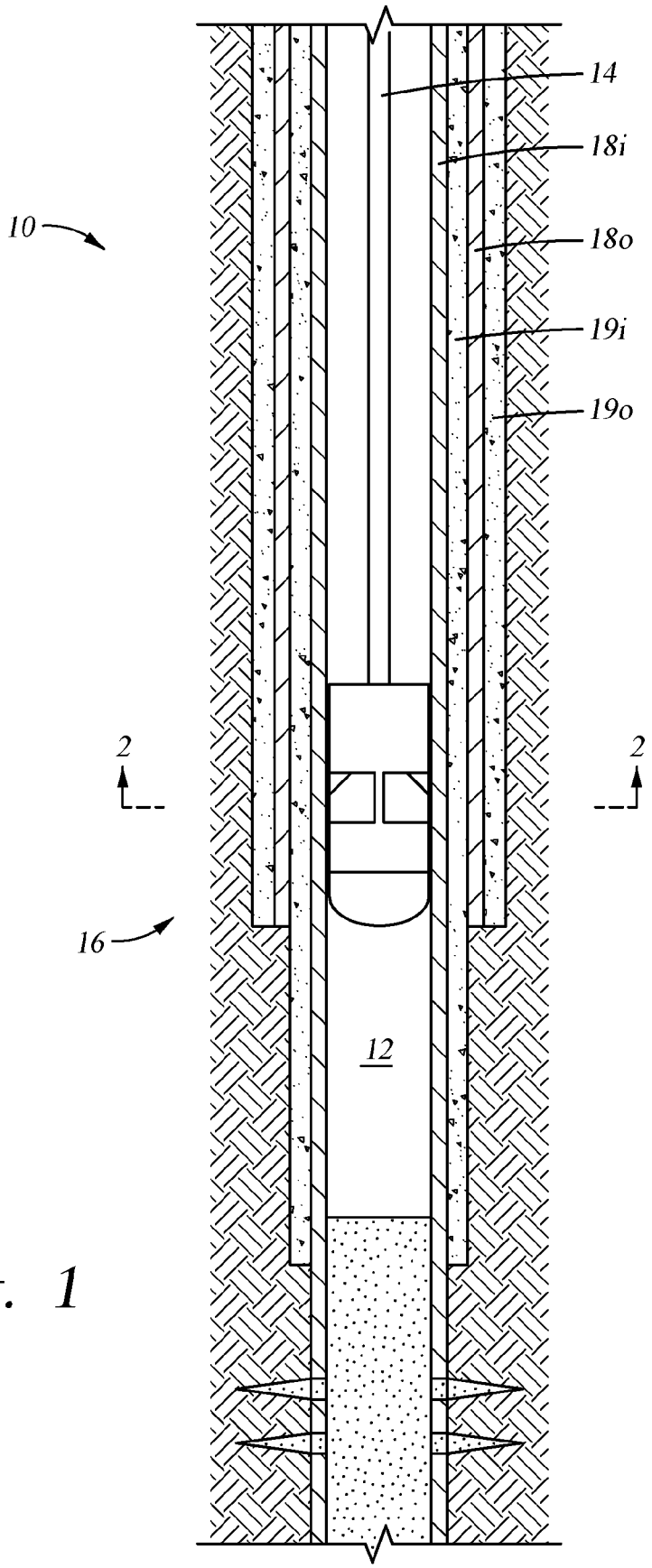
FIG. 1 illustrates a system having a cutter assembly for cutting a tubular in a wellbore, according to one embodiment of the present disclosure.

FIG. 1 illustrates a system 10 for cutting a tubular in a wellbore 12. An exemplary system 10 is disclosed in U.S. patent application Ser. No. 14/496,936, now U.S. Patent Publication 2015/0101812, which is hereby fully incorporated by reference, in particular, paragraphs [0023]-[0051] and [0075]-[0079] and FIGS. 1A, 2A-F, 3A-B, 4A-G, 11A-C.

Figure 2:
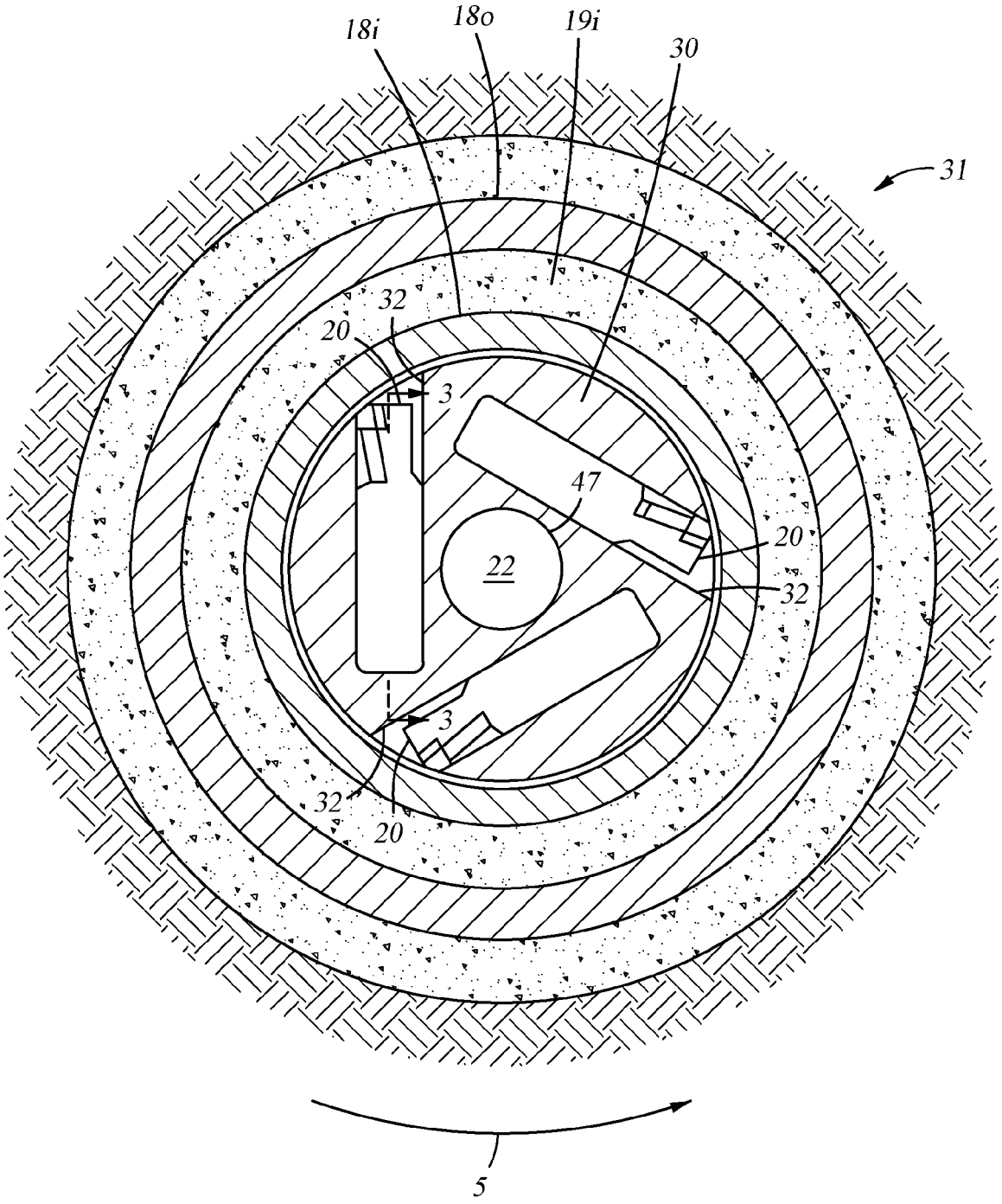
FIG. 2 is a bottom-up cross-sectional view of the cutter assembly in the wellbore.

The wellbore 12 includes at least one tubular 18, such as an inner tubular 18*i* and an outer tubular 18*o*. As used herein, the discussion relating to the tubular 18 may be similarly applied to the inner tubular 18*i* and/or the outer tubular 18*o*. Examples of suitable "tubulars" include casing, liner, drill pipe, drill collars, coiled tubing, production tubing, pipeline, and other suitable wellbore tubulars known to a person of ordinary skill in the art. In one embodiment, the inner and outer tubulars 18*i*, 18*o* are casing. The outer tubular 18*o* may be cemented with outer cement 190 into the wellbore 12. In one embodiment, the inner tubular 18*i* is hung from a wellhead and cemented with inner cement 19*i* into place. The inner and outer tubular 18*i*, 18*o* may include a plurality of tubular segments joined by tubular couplings. The system 10 may include a conveyor string 14 with a bottom hole assembly (BHA) 16 at a lower end thereof. The BHA 16 may include a rotatable cutter assembly 31, as shown in FIG. 2. The BHA 16 may be connected to the conveyor string 14, such as by threaded couplings. The BHA 16 is rotatable by a top drive via the conveyor string 14.

FIG. 2 illustrates a bottom-up view of the cutter assembly 31 with a housing bore 22. The inner and outer tubulars 18*i*, 18*o* may or may not be concentrically arranged. The cutter assembly 31 includes a housing 30 with a plurality of blades 20 (three shown) disposed in respective pockets 32 in the wall of the housing 30. In one embodiment, the number of blades 20 ranges from 2 to 10. In another embodiment, the number of blades 20 ranges from 3 to 6. In yet another embodiment, the number of blades 20 ranges from 2 to 4. Each pocket 32 may be eccentrically arranged relative to a center of the cutter assembly 31. Each blade 20 may have an eccentric extension path relative to the center of the cutter assembly 31, resulting in a larger available blade sweep than a radially arranged blade. Cutter assembly 31 may rotate 5 with respect to inner and outer tubulars 18*i*, 18*o*. Direction of rotation 5 distinguishes the leading face or surface of any element from the trailing face or surface.

Figure 3:
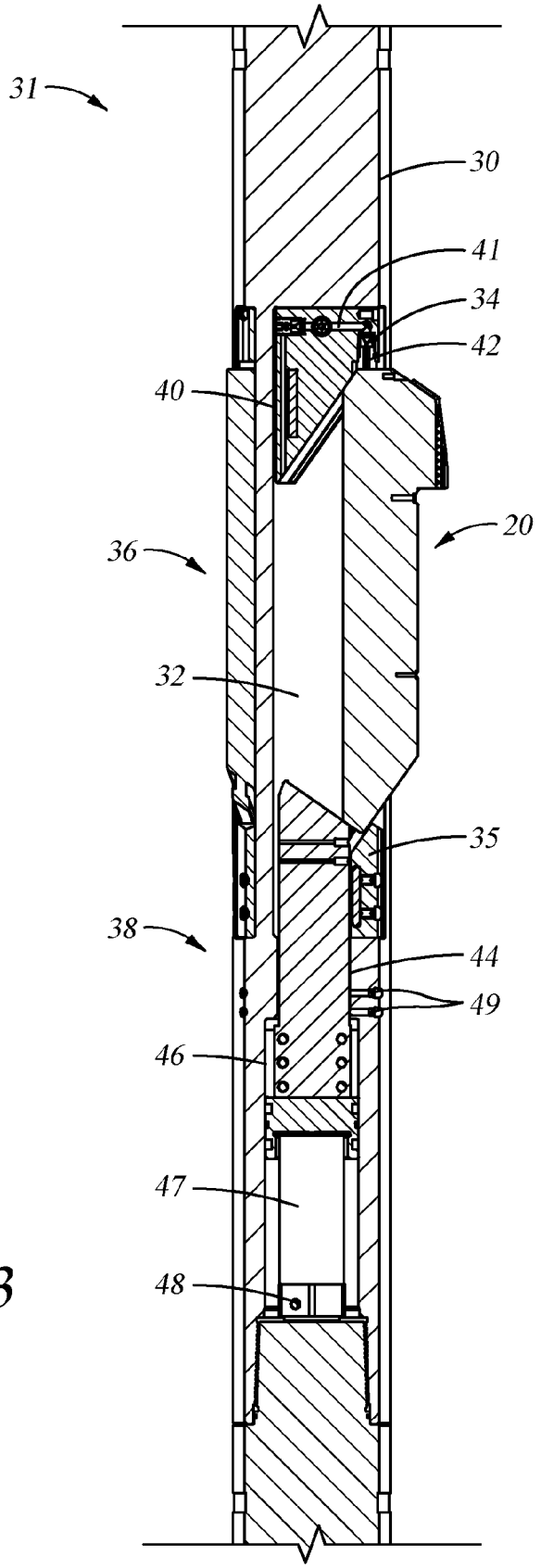
FIG. 3 is a side cross-sectional view of the cutter assembly.

FIG. 3 illustrates a section view, as indicated in FIG. 2, of an embodiment of the cutter assembly 31. The cutter assembly 31 includes the housing 30 with a cutter blade portion 36 and a cutter actuator portion 38. The cutter blade portion 36 includes the pocket 32 for receiving the blade 20. The blade 20 is disposed between an upper block 34 and a lower block 35, each of which is fixed at opposite ends of the pocket 32. In one embodiment, the upper block 34 includes one or more passages 40, 41 formed therethrough. The passages 40, 41 extend through the wall of the housing 30 from the housing bore 22 (FIG. 2) to the pocket 32, thereby guiding milling fluid to the pocket 32 to discourage infiltration of cuttings. For example, the milling fluid may include a base liquid, such as refined or synthetic oil, water, brine, or a water/oil emulsion. The milling fluid may further include solids dissolved or suspended in the base liquid, such as organophilic clay, lignite, and/or asphalt, thereby forming a mud. The blade 20 and the upper and lower blocks 34, 35 include correspondingly angled mating surfaces for guiding the blade 20 between a retracted position and an extended position. In the retracted position, the blade 20 is disposed in the pocket 32, as shown in FIG. 2. In the extended position, at least a portion of the blade 20 extends from the pocket 32, as shown in FIG. 3. The mating surfaces between the blade 20 and the upper and lower blocks 34, 35 are arranged such that the blade 20 extends laterally outward (towards tubular 18*i* in FIG. 2, towards the right of the page in FIG. 3) and/or upward (out of the page in FIG. 2, towards the top of the page in FIG. 3), corresponding to an angle of the mating surfaces. During operation, the blade 20 may extend outwards and/or upwards prior to or while engaging with a tubular 18. Consequently, blade 20 may initially cut tubular 18 outwardly and/or upwardly. In one embodiment, the upper block 34 includes an adjustable stop 42 for stopping the extension of the blade 20. In one embodiment, the stop 42 is configured to control a depth of cut of the blade 20 into a tubular 18. The depth of cut is defined by a radial cutting distance extending from the housing 30. The stop 42 may be adjusted to control the depth of cut of the blade 20. For example, increasing the intrusion of the stop 42 into the pocket 32 decreases the depth of cut, and decreasing the intrusion of the stop 42 increases the depth of cut.

The cutter actuator portion 38 includes an actuator arm 44 in a chamber 46 formed between the housing 30 and a mandrel 47 in the housing bore 22. The actuator arm 44 seals the chamber 46 between an upper portion and a lower portion. In one embodiment, the upper portion is in fluid communication with the pocket 32. The lower portion of the chamber 46 is in fluid communication with the housing bore 22 via a port 48 in the mandrel 47 and the wall of the housing 30. The actuator arm 44 is movable between an upper position and a lower position. The actuator arm 44 is initially restrained in the lower position by one or more shear pins 49. For example, a pressure differential between a fluid pressure in the housing bore 22 and a fluid pressure in the pocket 32 may exert a net upward actuation force on the actuator arm 44 when milling fluid is pumped through the housing bore 22. Collectively, the shear pins 49 may fasten the actuator arm 44 to the housing 30 until the upward actuation force reaches a shear force necessary to fracture the shear pins 49 and release the actuator arm 44 from the lower position. The upper actuation force may increase as an injection rate of milling fluid through the housing 30 is increased until the injection rate reaches an activation threshold of the actuator arm 44, which is sufficient to shear the shear pins 49. In one embodiment, the actuator arm 44 includes a tapered upper surface for engaging a tapered lower surface of the blade 20. By releasing the actuator arm 44 from the lower position, the actuator arm 44 moves upward and acts on the blade 20, thereby causing the blade 20 to extend outward and/or upward. For example, the tapered upper surface on the actuator arm 44 acts on the tapered lower surface of the blade 20 to extend the blade 20.

In some embodiments, an electronics package may operate actuator arm 44. For example, shear pins 49 may be replaced by a locking mechanism 49'. In response to an electronic signal, locking mechanism 49' may release the actuator arm 44 from the lower position. The electronic signal may be transmitted through wired or wireless communication, and an RFID tag may be used to send the electronic signal.

Figures 4A, 4B:
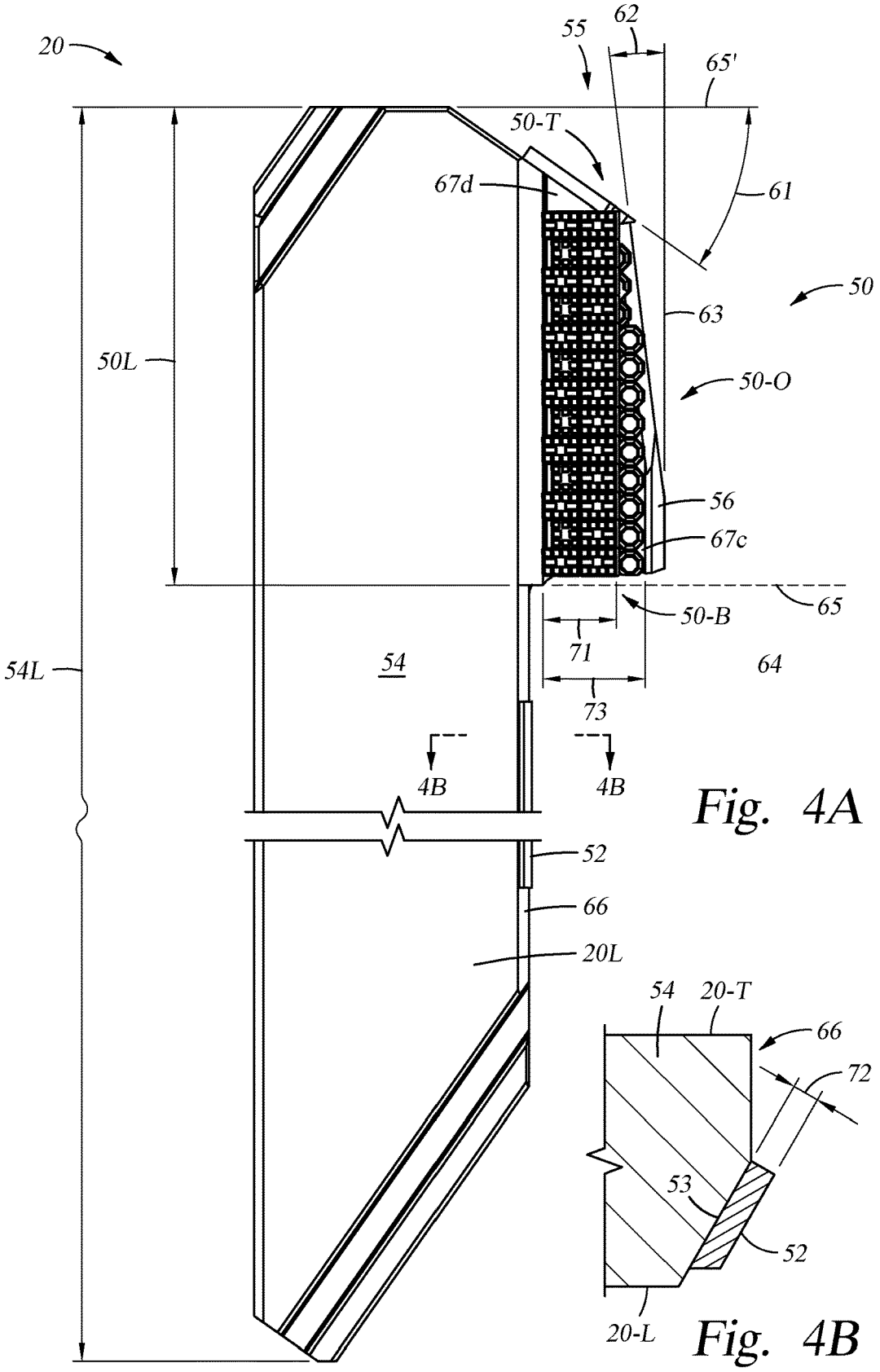
FIGS. 4A and 4B illustrate an exemplary embodiment of a cutter blade of the cutter assembly of FIG. 1.

FIGS. 4A and 4B illustrate an exemplary embodiment of the blade 20. The blade 20 includes a body 54 with a cutting portion 50, an outer surface 66, and an integral stabilizer 52 proximal to the outer surface 66. (This disclosure discusses below stabilizers associated with a stabilizer assembly 80. As used herein, "integral stabilizer" indicates that the stabilizer is associated with cutter assembly 31, rather than stabilizer assembly 80. "Integral stabilizer" should not be read to indicate any particular type of material, assembly, attachment method, or manufacturing method, but only that the stabilizer is associated with cutter assembly 31.) The blade body may have a length 54L selected to provide appropriate blade extension for operational needs. In some embodiments, the length 54L may be between about 15 inches and about 50 inches or between about 20 inches and about 30 inches. In some embodiments, the length may be between about 23 inches and about 27 inches. In some embodiments, the length may be between about 24 inches and about 25 inches. The blade 20 also includes a leading side 20-L (shown in FIG. 4A) and a trailing side 20-T (not visible in FIG. 4A). The outer surface 66 may be made up of one or more planes. For example, as illustrated in FIG. 4B, a leading edge of outer surface 66 may be shaved or angled slightly inward. Integral stabilizer 52 may be disposed on the leading-outward surface 53.

Figure 5A:
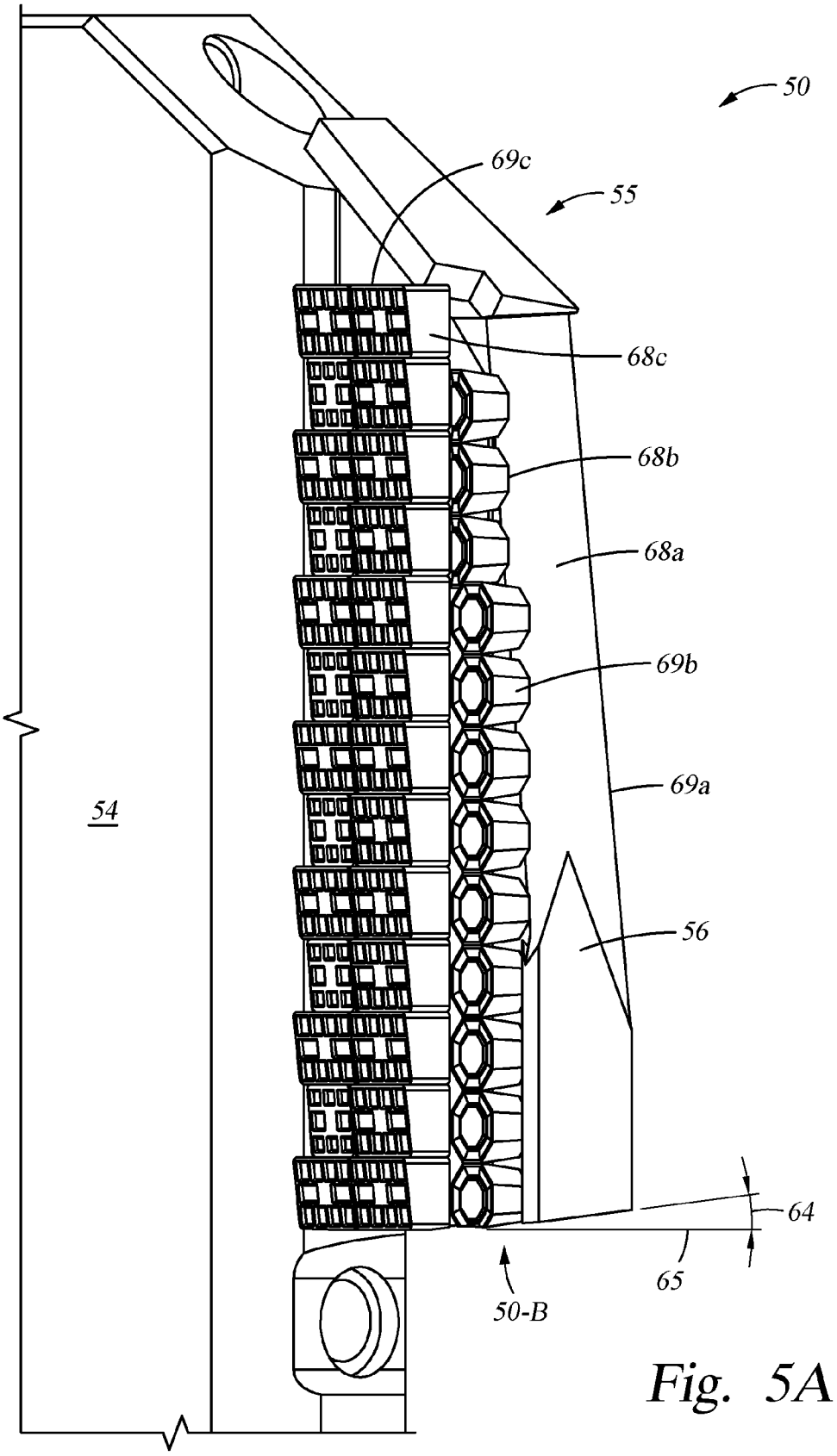
FIG. 5A is an enlarged view of the cutter blade of FIG. 4A.
Figure 5B:
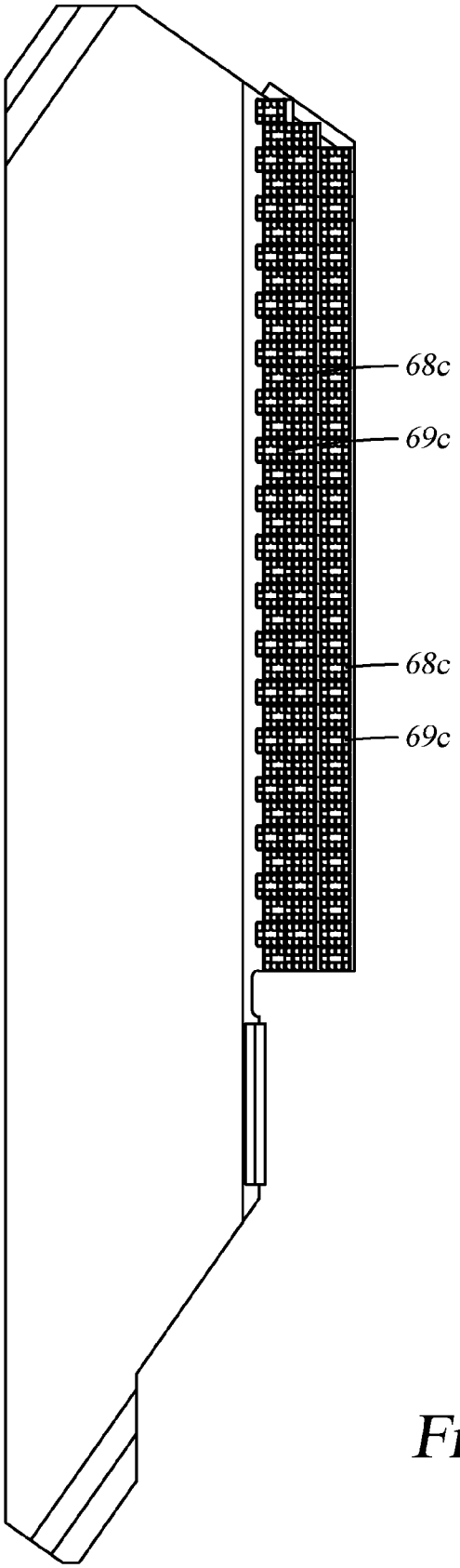
FIGS. 5B-5D illustrate alternative cutter blades.

The cutting portion 50 may be formed on a protrusion 55 of the body 54, as shown in FIGS. 4A and 5A. In one embodiment, the cutting portion 50 has a length 50L substantially shorter than a length 54L of the body 54, such as less than or equal to 50% thereof. In another embodiment, the cutting portion 50 has a length 50L equal to or less than a length 54L of the body 54, such as between about 25% and 75% of length 54L. The cutting portion 50 is configured to cut the tubular 18 both laterally and axially. In some embodiments, blade 20 is configured to preferentially cut axially downward, sometimes referred to as "milling down". In such embodiments, as illustrated in FIG. 5B, the length 50L of cutting portion 50 may be between 40% and 70% of the length 54L of the body 54. In some embodiments, cutting portion 50 is configured to cut through a tubular, thereby making a full-thickness cut. In some embodiments, cutting portion 50 is configured to make a partial-thickness cut, thereby reducing the thickness of the tubular at the proximity of the cut. The length 50L of cutting portion 50 may be selected to provide appropriate blade extension for operational needs. In some embodiments, the length 50L may be between about 8 inches and about 18 inches. In some embodiments, the length may be between about 10 inches and about 15 inches. In some embodiments, the length may be between about 13 inches and about 14 inches.

Cutting portion 50 may be configured to cut the tubular with a desired shape or geometry, such as a groove, dovetail, or other desired cut shape or profile. In some embodiments, cutting portion 50 cuts a profile into the tubular to prepare the tubular for subsequent device latching. In some embodiments, cutting portion 50 cuts a notch into the tubular, thereby scoring the tubular for later axial separation at the proximity of the cut. In some embodiments, the profile may be a substantially uniform (within +/−10%) feature machined into the inner wall of the tubular. Cutting portion 50 may cut the tubular in any fashion that removes material, including milling, grinding, machining, chipping, boring, plaining, shaving, etc.

Figure 5C:
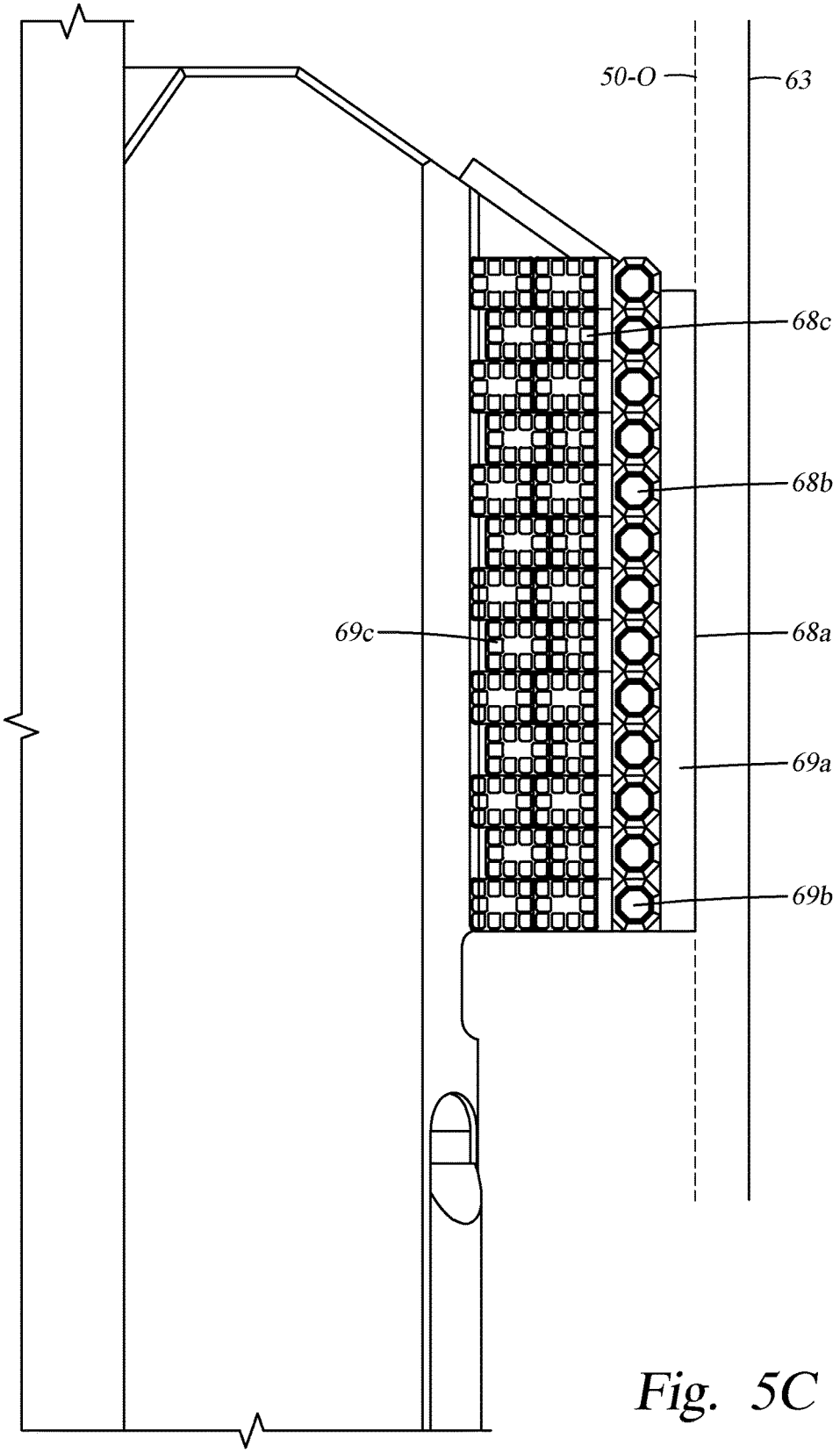

In one embodiment, as illustrated in FIG. 5C, an outer surface 50-O of the cutting portion 50 follows a vertical line 63 that is parallel relative to a longitudinal axis of the housing 30. In another embodiment, the outer surface 50-O of the cutting portion 50 is tapered 62 slightly outwardly from top to bottom, as shown in FIGS. 4A and 5A. In one example, the outer taper 62 ranges from 3 degrees to 20 degrees relative to vertical line 63. In another example, the outer taper 62 ranges from 5 degrees to 18 degrees, such as 7 or 15 degrees. In another example, the outer taper 62 ranges from 6 degrees to 8 degrees. The outer surface 50-O may include two or more angled surfaces, thereby comprising two or more outer tapers 62. In yet another embodiment, the outer surface 50-O may include an arcuate outer surface or a combination of arcuate and angled surfaces.

In one embodiment, as illustrated in FIG. 4A, a bottom surface 50-B of the cutting portion 50 follows a horizontal line 65 that is perpendicular relative to the longitudinal axis of the housing 30. In another embodiment, the bottom surface 50-B is tapered 64 slightly upward from an outer surface 66 of the body 54 to the outer surface 50-O of the cutting portion 50, as shown in FIG. 5A. In one example, the bottom taper 64 ranges from 0 degrees to 8 degrees relative to horizontal line 65. In another example, the bottom taper 64 ranges from 4 degrees to 7 degrees, such as 5 degrees.

In one embodiment, a top surface 50-T of the cutting portion 50 follows a horizontal line 65' that is perpendicular relative to the longitudinal axis of the housing 30. In another embodiment, the top surface 50-T is tapered 61 slightly downward, as shown in FIG. 4A. In one example, the top taper 61 ranges from 0 degrees to 60 degrees relative to horizontal line 65'. In another example, the top taper 61 ranges from 15 degrees to 45 degrees, such as 35 degrees.

The cutting portion 50 may provide an increased cutting pressure when cutting the tubular 18, thereby reducing or eliminating any bearing effect. In one example, when the blade cuts axially downward, the bottom taper 64 of the cutting portion 50 allows the cutting portion 50 to engage the tubular 18 with more cutting pressure inwardly on the bottom surface 50-B, and with less cutting pressure outwardly on the bottom surface 50-B, thereby increasing cutting efficiency. In another example, when the blade 20 cuts laterally outwards and/or axially upwards, the outer taper 62 allows a lower tapered end of the cutting portion 50 to engage the tubular 18 before the rest of the cutting portion 50, thereby increasing cutting efficiency. Furthermore, the outer taper 62 may provide an increased rate of cut when laterally cutting the tubular 18, thereby reducing or eliminating chatter and/or stalling.

As illustrated in FIGS. 5A-D, the cutting portion 50 includes a combination of any appropriate cutting structures 68 having materials (for example, tungsten carbide) suitable for cutting the tubular material (for example, steel). The cutting structures 68 may be bonded to the protrusion 55 of the body 54 using any suitable manner, such as brazing. In one embodiment, the cutting portion 50 includes a plurality of independently purposed cutting structures 68*a-c* arranged on the top surface 50-T, outer surface 50-O, and/or bottom surface 50-B of cutting portion 50. In some embodiments, the cutting structures 68*a-c* may be tiered along the outer surface 50-O. As illustrated in FIG. 4A, the tiered cutting structures 68*a-c* may be arranged in rows of varying thickness (for example, thickness 71 and thickness 73). As illustrated in FIG. 5A, trailing cutting structure 68*a* forms an outer row towards the trailing side of the cutting portion 50, intermediate cutting structure 68*b* forms an intermediate row, and leading cutting structure 68*c* forms an inner row towards the leading side of cutting portion 50. In some embodiments, the trailing cutting structure 68*a* and/or the intermediate cutting structure 68*b* may be configured to initiate a cut in the tubular 18. In some embodiments, the leading cutting structure 68*c* may be configured to cut axially downward along the length of the casing. In some embodiments, the trailing cutting structure 68*a* and/or the intermediate cutting structure 68*b* and/or the leading cutting structure 68*c* may be configured to initiate a cut in the tubular 18 and/or to cut axially downward along the length of the casing. In one embodiment, the rows of cutting structure 68*a-c* at least partially overlap. For example, as shown in FIG. 5A, trailing cutting structure 68*a* overlaps intermediate cutting structure 68*b* near the top surface 50-T. While only three rows of cutting structures 68 are shown, any appropriate number of rows may be used, any configuration of tiering or thicknesses may be used, and any extent of overlap may be used.

Figure 7A:
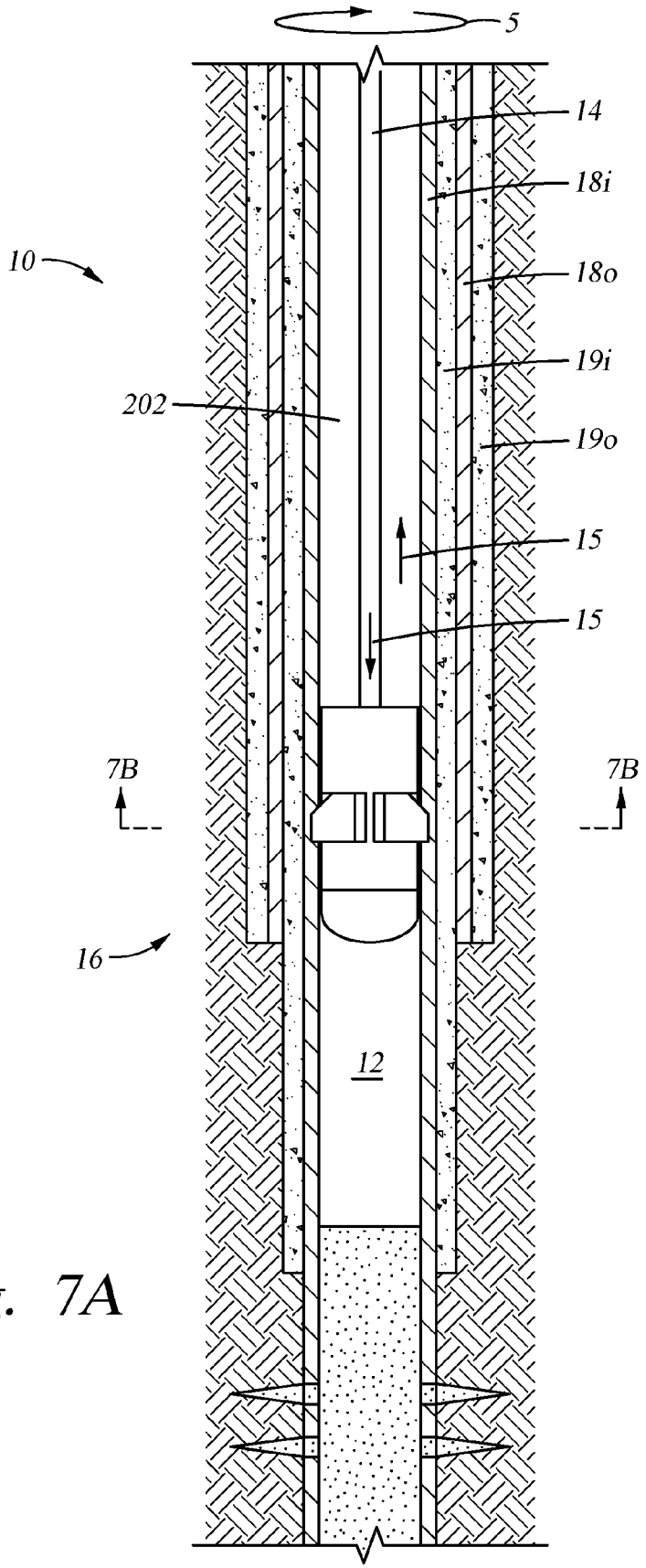
FIGS. 7A-7D illustrate an exemplary operation of the cutter assembly of FIG. 1.

In one embodiment, the trailing cutting structure 68*a* is disposed on outer surface 50-O and/or top surface 50-T of the cutting portion 50, as shown in FIGS. 4A and 5A. The trailing cutting structure 68*a* may be configured to cut the tubular 18 while the cutter assembly 31 rotates and/or while blade 20 extends outward and/or upward. In one embodiment, the trailing cutting structure 68*a* cuts laterally outwards and/or axially upwards into the tubular 18. In some embodiments, top surface 50-T may deform tubular 18 in lieu of or in addition to cutting. This may be more likely for thin tubulars 18. The trailing cutting structure 68*a* may cut the tubular 18 while the blade 20 extends, thereby forming a window in the tubular 18. For example, the blade 20 forms a window 204 in the inner tubular 18*i*, as shown in FIG. 7C. The window 204 may have a longitudinal length greater than or equal to the length 50L of the cutting portion 50. In some embodiments, the window 204 may have a longitudinal length ranging from 3 inches to 8 inches, or 4 inches to 6 inches, such as 5 inches. In one embodiment, the trailing cutting structure 68*a* includes crushed carbide 69*a*. The crushed carbide 69*a* may partially or entirely wear away while cutting the tubular 18. In one embodiment, an outward-facing surface of the crushed carbide 69*a* includes a suitable coating for cushioning an impact between the blade 20 and the tubular 18, such as an epoxy coating 56. The epoxy coating 56 is configured to reduce or prevent chipping of the cutting portion 50 upon initial contact with the tubular 18. In some embodiments, as illustrated in FIG. 5B, trailing cutting structure 68*a* may not be present.

Figure 6A:
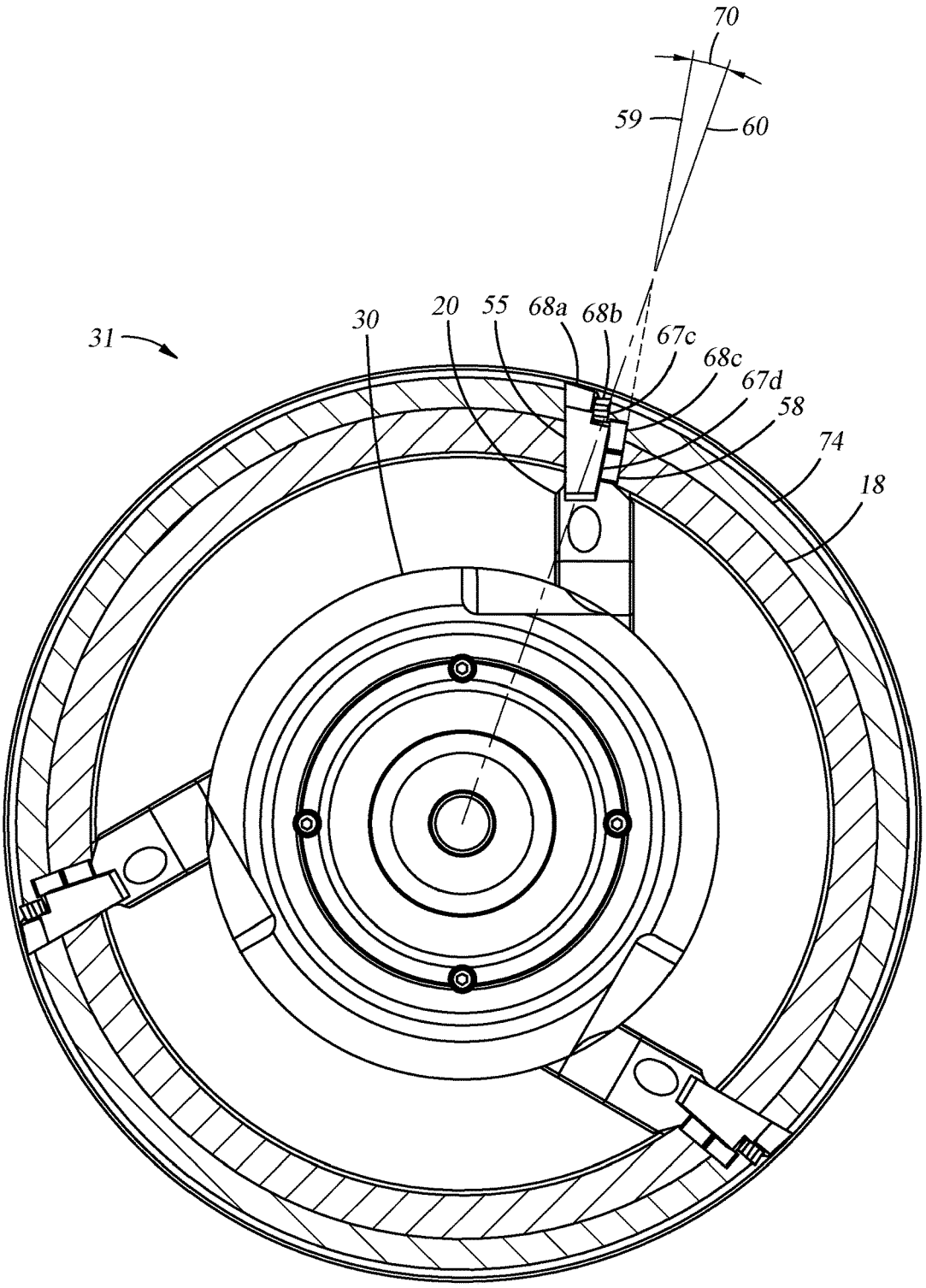
FIG. 6A is top-down cross-sectional view of the cutter assembly cutting the tubular and a tubular coupling.

In one embodiment, the intermediate cutting structure 68*b* forms a first leading face 67*c* of the cutting portion 50, as shown in FIGS. 4A and 6A. The intermediate cutting structure 68*b* may be configured to cut the tubular 18 while the cutter assembly 31 rotates. In one embodiment, the intermediate cutting structure 68*b* is configured to cut laterally outwards into the tubular 18. The intermediate cutting structure 68*b* cuts the tubular 18 while the blade 20 extends to form the window 204. In one embodiment, the intermediate cutting structure 68*b* includes chip breaker inserts 69*b* made of any suitable material, such as tungsten carbide. The chip breaker inserts 69*b* may have a cross-section of any suitable shape, such as circular or polygonal with at least five sides, as many as eight sides, or more. The chip breaker inserts 69*b* are configured to break tubular cuttings into smaller segments. For example, a contact surface between each chip breaker insert 69*b* and the tubular 18 may continuously change as the blade 20 cuts the tubular 18, thereby reducing the size of the tubular cutting segments. The tubular cutting segments may be removed from the cutter assembly 31 by injecting milling fluid therethrough. In one embodiment, the chip breaker inserts 69*b* are spaced apart on the cutting portion 50, as shown in FIG. 5A. In one embodiment, the chip breaker inserts 69*b* reflect the outer taper 62 of the cutting portion 50. In one example, the intermediate row of chip breaker inserts 69*b* includes a combination of whole inserts and half inserts, as shown in FIG. 5A. In another example, the intermediate row of chip breaker inserts 69*b* includes inserts of increasing size from top to bottom. In some embodiments, as illustrated in FIG. 5B, intermediate cutting structure 68*b* may comprise carbide inserts 69*c*.

Figure 5D:
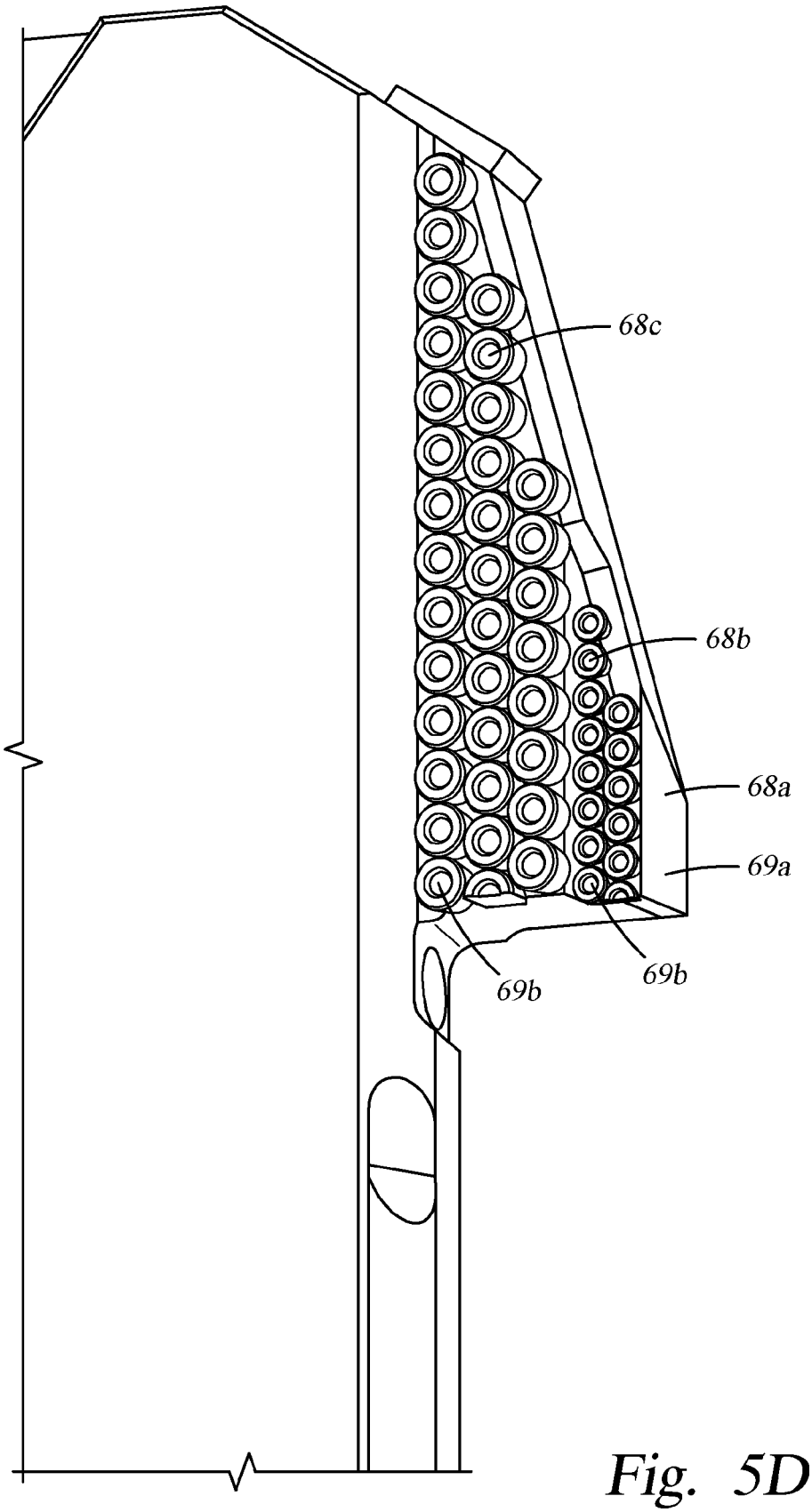

In one embodiment, the leading cutting structure 68*c* forms a portion of the first leading face 67*c*. In another embodiment, the leading cutting structure 68*c* forms a second leading face 67*d* of the cutting portion 50, as shown in FIGS. 4A and 6A. The leading cutting structure 68*c* is configured to cut the tubular 18 while the cutter assembly 31 rotates. In one embodiment, the leading cutting structure 68*c* is configured to cut axially downwards into the tubular 18. For example, the leading cutting structure 68*c* cuts into an exposed wall thickness of the tubular 18. In one embodiment, the leading cutting structure 68*c* includes any suitable material suitable for cutting casing, such as carbide inserts 69*c*. The carbide inserts 69*c* are configured to longitudinally extend the window 204. For example, after the window 204 in the inner tubular 18*i* is formed, the carbide inserts 69*c* are positioned in the window 204. Thereafter, the BHA 16 may be urged downward and cut the inner tubular 18*i*, thereby longitudinally extending the window 204. After longitudinally extension, the window 204 may have a longitudinal length greater than or equal to the length 50L of the cutting portion 50. In some embodiments, after longitudinally extension, the window 204 may have a longitudinal length greater than or equal to the length 54L of the body 54. In some embodiments, as illustrated in FIG. 5D, leading cutting structure 68*c* may comprise chip breaker inserts 69*b*.

Figure 6B:
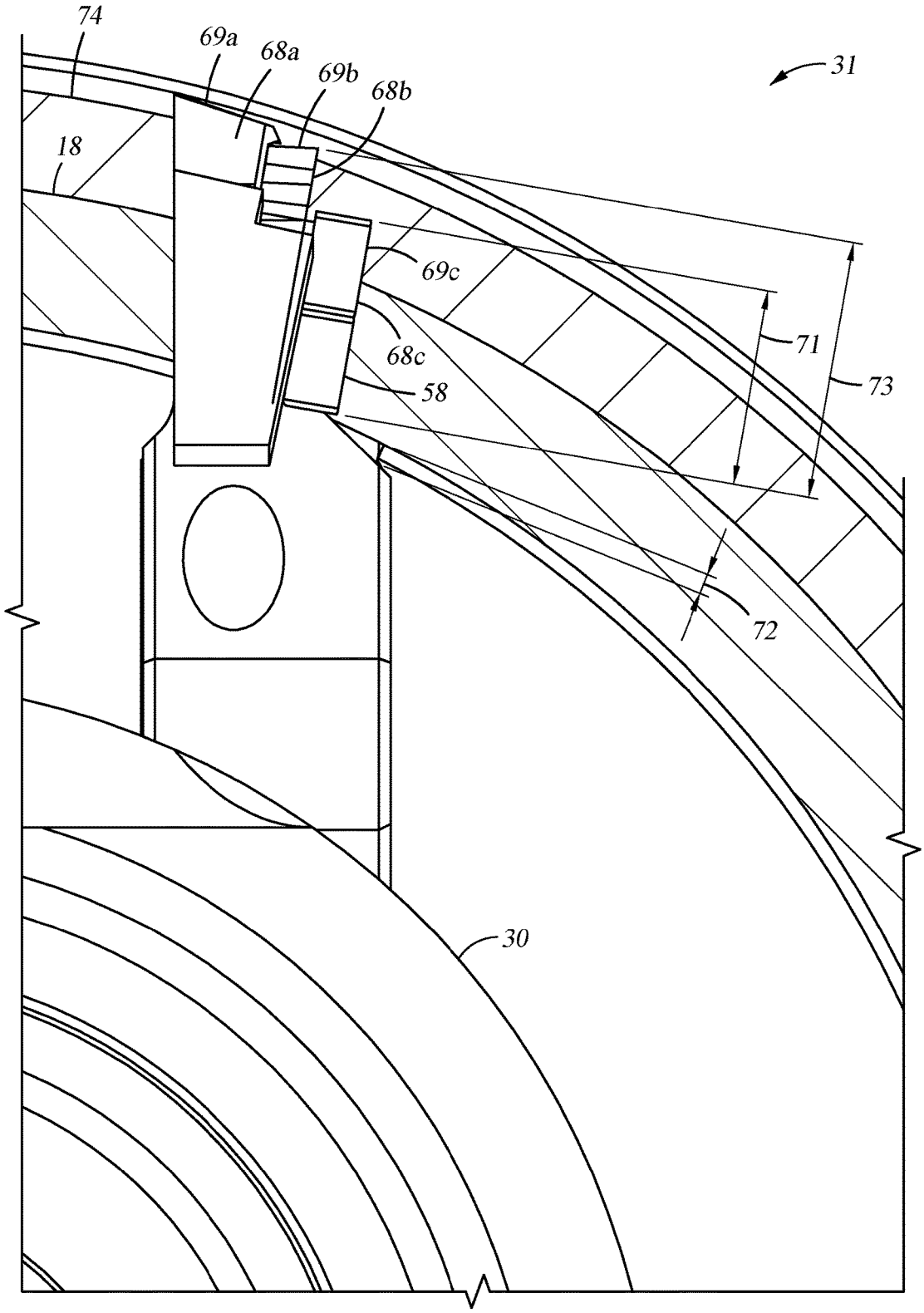
FIG. 6B is an enlarged top-down cross-sectional view of the cutter assembly of FIG. 6A.

FIGS. 6A and 6B illustrate the cutter assembly 31 engaging a tubular 18 that is surrounded by a tubular coupling 74. The second leading face 67*d* may have a thickness 71 at least as long as a wall thickness of the tubular 18, as shown in FIG. 6B. The first leading face 67*c* may have a thickness 73. The thickness 73 is selected such that the depth of cut of the intermediate cutting structure 68*b* and the leading cutting structure 68*c* is sufficient to cut the tubular 18 and/or a tubular coupling 74, as shown in FIG. 6B. In one embodiment, more than one carbide insert 69*c* is combined to provide the appropriate thickness 71 of the leading cutting structure 68*c* for cutting the tubular 18. In one embodiment, the leading cutting structure 68*c* includes a combination of half and/or whole carbide inserts 69*c*, as shown in FIGS. 4A and 5A. The carbide inserts 69*c* may be arranged such that space between adjacent carbide inserts 69*c* is minimized or eliminated. For example, a side of each carbide insert 69*c* may contact effectively an entire side of an adjacent carbide insert 69*c*. Adjacent carbide inserts 69*c* may form a seamline at vertical and horizontal interfaces therebetween. In one embodiment, a vertical seamline between horizontally adjacent carbide inserts 69*c* is aligned with a vertical seamline above and/or below the adjacent carbide inserts 69*c* thereby forming a continuous seamline, as shown in FIGS. 4A and 5A. In another embodiment, the vertical seamline between horizontally adjacent carbide inserts 69*c* is not aligned with the vertical seamline above and/or below the adjacent carbide inserts 69*c*, thereby forming a discontinuous seamline. For example, a combination of half and/or whole carbide inserts 69*c* may be arranged on the first or second leading faces 67*c,d* of the cutting portion 50 such that a vertical seamline of a first set of adjacent carbide inserts 69*c* is not horizontally aligned with a seamline of a second set of adjacent carbide inserts 69*c* above and/or below the first set. In one embodiment, a horizontal seamline between vertically adjacent carbide inserts 69*c* is aligned with a horizontal seamline on either side of the adjacent carbide inserts 69*c*, as shown in FIGS. 4A and 5A. In another embodiment, the horizontal seamline between vertically adjacent carbide inserts 69*c* is not aligned with the horizontal seamline on either side of the adjacent carbide inserts 69*c*. For example, a combination of half and/or whole carbide inserts 69*c* may be arranged on the first or second leading faces 67*c,d* of the cutting portion 50 such that a horizontal seamline of a first set of adjacent carbide inserts 69*c* is not vertically aligned with a seamline of a second set of adjacent carbide inserts 69*c* on either side of the first set. In one embodiment, the carbide inserts 69*c* on each blade 20 are arranged such that the vertical and/or horizontal seamlines on one blade 20 are horizontally and/or vertically staggered with corresponding seam lines on at least one other blade 20.

The carbide inserts 69*c* may form a leading cutting face 58, as shown in FIGS. 6A and 6B. The leading cutting face 58 defines a cutting plane 59 which is parallel or substantially parallel to a reference plane 60 passing through a center of the housing 30 and the leading edge of the outer surface 50-O of the cutter blade 20. In one embodiment, substantially parallel to the plane 60 includes an attack angle 70 up to +/−10 degrees between the cutting plane 59 and the reference plane 60. In another embodiment, substantially parallel includes an attack angle 70 up to +/−7 degrees. In another embodiment, substantially parallel includes an attack angle 70 up to +/−4 degrees. In another embodiment, substantially parallel includes an attack angle 70 up to +/−1 degree.

In one embodiment, some or all of the carbide inserts 69*c* include negative rake angles when cutting axially downward, as shown in FIG. 5A. For example, a leading surface of the carbide insert 69*c* may be sloped relative to a trailing surface of the carbide insert 69*c*, which may be bonded to the protrusion 55. The negative rake angle may range from 0 degrees to 7 degrees.

While each of the cutting structures 68*a-c* include distinguishable cutters, the cutting structures 68*a-c* may include any combination of carbide inserts, tungsten carbide chip breaker inserts, and/or crushed carbide. In an embodiment, the trailing cutting structure 68*a* includes crushed carbide, and both the intermediate and leading cutting structures 68*b*, 68*c* include carbide inserts 69*c*. In an embodiment, the trailing cutting structure 68*a* includes crushed carbide 69*a*, the intermediate cutting structure 68*b* includes chip breaker inserts 69*b*, and the leading cutting structure 68*c* includes carbide inserts 69*c*. In yet another embodiment, the trailing cutting structure 68*a* includes crushed carbide, and both the intermediate and leading cutting structures 68*b*, 68*c* include chip breaker inserts 69*b*.

In one embodiment, the blade 20 includes the integral stabilizer 52 on at least a portion of the outer surface 66 of the blade body 54. For example, the integral stabilizer 52 may be formed in a groove on the outer surface 66. For example, the integral stabilizer 52 may be pressed into a groove and fixed into place, such as by welding. Engagement between the integral stabilizer 52 and the inner tubular 18*i* may stabilize the cutter assembly 31 and prevent damage to the outer tubular 18*o* while the cutter assembly 31 cuts the inner tubular 18*i*. A longer integral stabilizer 52—due to a longer body length 54L, a shorter blade length 50L, or an increased portion of outer surface 66 including integral stabilizer 52—may provide increased or improved stabilization of the cutter assembly 31. The integral stabilizer 52 may be made from a material harder than the casing material, such as tool steel, ceramic, or cermet. The integral stabilizer 52 may be made from a matrix of composite material bonded to the body 54. In one embodiment, the composite material is bonded to the outer surface 66 by a metallurgical bond, such as by plasma arc welding, laser cladding, or any other suitable hard banding process. It is currently believed that such metallurgical bond may significantly reduce heat input to and/or warpage of the blade 20. The matrix of the composite material includes a binder material. For example, the binder material may be pure silver or nickel silver. The composite material may include a material harder than the tubular 18 material. In one embodiment, the composite material includes a carbide rod, Teflon, and/or a hardfacing alloy, such as tungsten carbide. In one embodiment, the composite material is disposed onto the outer surface 66 in layers. In one embodiment, the composite material does not require preheating before being bonded to the outer surface 66. The composite material may be applied to the outer surface 66 by applying localized heat to the blade 20. Multiple layers of the composite material may be added to the outer surface 66, thereby forming a desired profile of the integral stabilizer 52. In one embodiment, the integral stabilizer 52 includes a rounded profile conforming to the inner surface of the tubular 18. The rounded profile of the integral stabilizer 52 may provide a surface contact between the integral stabilizer 52 and the tubular 18. The surface contact may reduce friction between the blade 20 and the tubular 18 and/or reduce contact stresses on the integral stabilizer 52. In another embodiment, the integral stabilizer 52 includes a flat profile, as shown in FIG. 4B. The flat profile of the integral stabilizer 52 may initially provide at least two linear contacts (one at each edge of the flat profile) with the tubular 18, thereby spreading the pressure. In one embodiment, the flat integral stabilizer 52 may be altered to have the rounded profile, such as by grinding the integral stabilizer 52. In another embodiment, the flat integral stabilizer 52 may become round during the use of the BHA 16, such as by rotating the cutter assembly 31 and engaging the flat integral stabilizer 52 with the tubular 18. In turn, the integral stabilizer 52 may conform to the inner surface of the tubular 18. For example, the composite material at the linear contact interface between the integral stabilizer 52 and the tubular 18 may break away, thereby forming a surface contact therebetween. The matrix of the composite material may allow the composite material to more easily break away into finer chips, as compared to integral stabilizers made of a non-composite material. The profile of integral stabilizer 52 may be selected to provide wear resistance and/or chipping resistance, thereby increasing the useful life of the integral stabilizer and providing better stabilization during cutting and axially and/or downwardly.

As seen in FIG. 4B, the integral stabilizer 52 may have an adjustable thickness 72 for use with various tubular wall thicknesses. In one embodiment, the thickness 72 is increased by applying more layers of the composite material. The thickness 72 of the integral stabilizer 52 may affect the depth of cut of the blade 20. For example, increasing the thickness 72 may decrease the depth of cut, and decreasing the thickness 72 may increase the depth of cut. The thickness 72 may be selected such that the cutting portion 50 is capable of cutting both the tubular 18 and the tubular coupling 74, as shown in FIGS. 6A and 6B. In one embodiment, the thickness 72 may be selected such that a sweep of the integral stabilizer 52 is between a drift diameter and a nominal inner diameter of the tubular 18, as shown in FIG. 6B.

FIGS. 7A-7D illustrate an exemplary operation of the BHA 16. The BHA 16 may be assembled and deployed into the inner tubular 18*i* using the conveyor string 14. In one embodiment, the inner tubular 18*i* is tubing disposed in casing. In another embodiment, the inner tubular 18*i* is casing/liner disposed in the wellbore 12. In yet another embodiment, the inner tubular 18*i* is an inner casing/liner disposed in an outer casing/liner 18*o*, as shown in FIGS. 7A-7D. Cement may or may not be disposed on an outer surface of any one or more of the nested tubulars.

During deployment of the BHA 16, milling fluid may be circulated by a mud pump at a flow rate less than the activation threshold of the actuator arm 44. In one embodiment, the BHA 16 is positioned where an upper portion of the inner tubular 18*i* and a lower portion of the outer tubular 18*o* overlap, as shown in FIG. 7A. The BHA 16 may be positioned at a coupling of the inner tubular 18*i*. The BHA 16 may then be rotated (as shown by arrow 5). Thereafter, injection of the milling fluid may be increased to at least the activation threshold of the actuator arm 44, thereby releasing the actuator arm 44 from the lower position. In turn, the actuator arm 44 moves the blade 20 upward and outward until the outer row of cutting structures 68*a* engages the inner surface of the inner tubular 18*i*. In one embodiment, the epoxy coating 56 cushions the impact between the blade 20 and the inner tubular 18*i*.

Figure 7B:
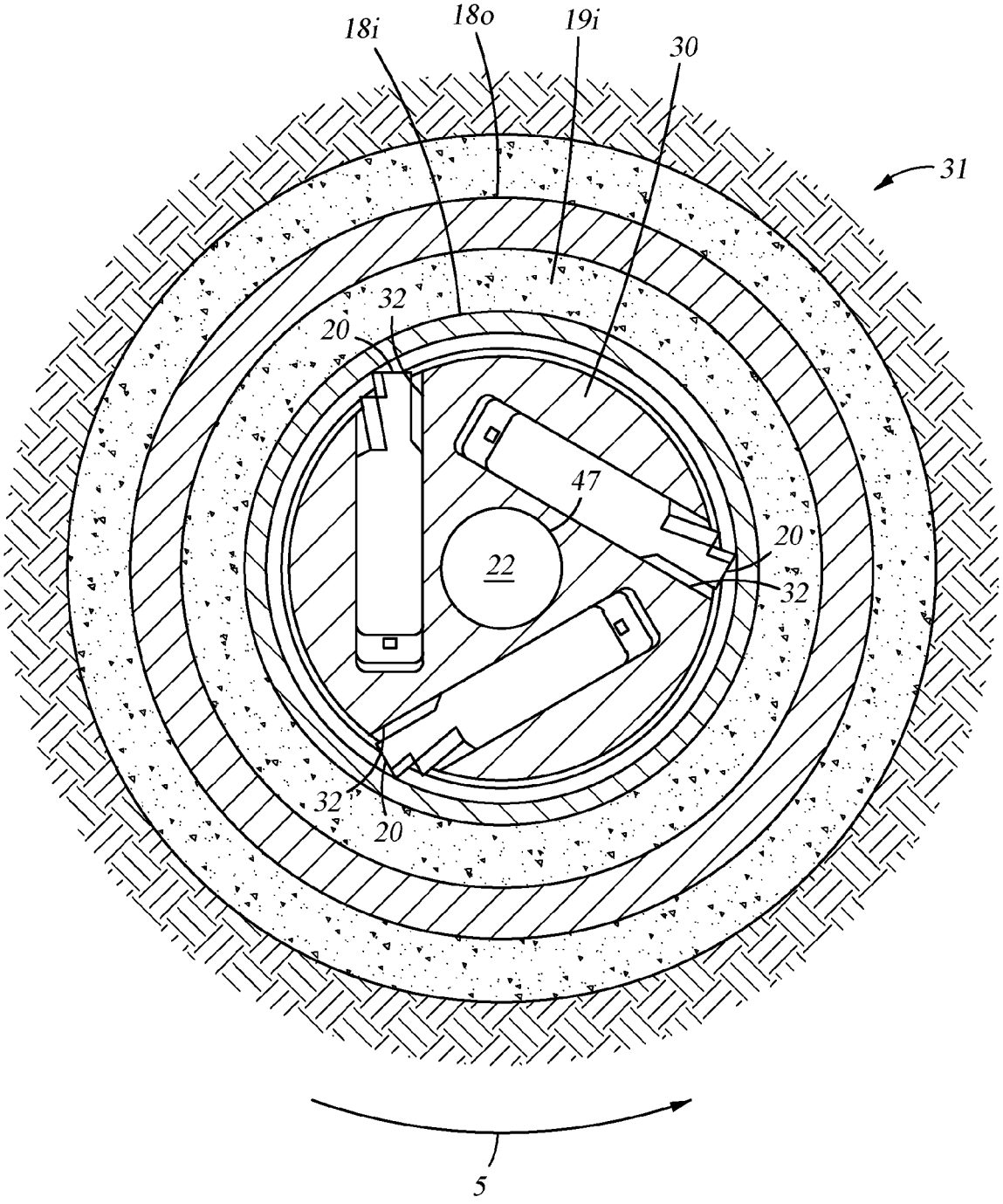
Figure 7C:
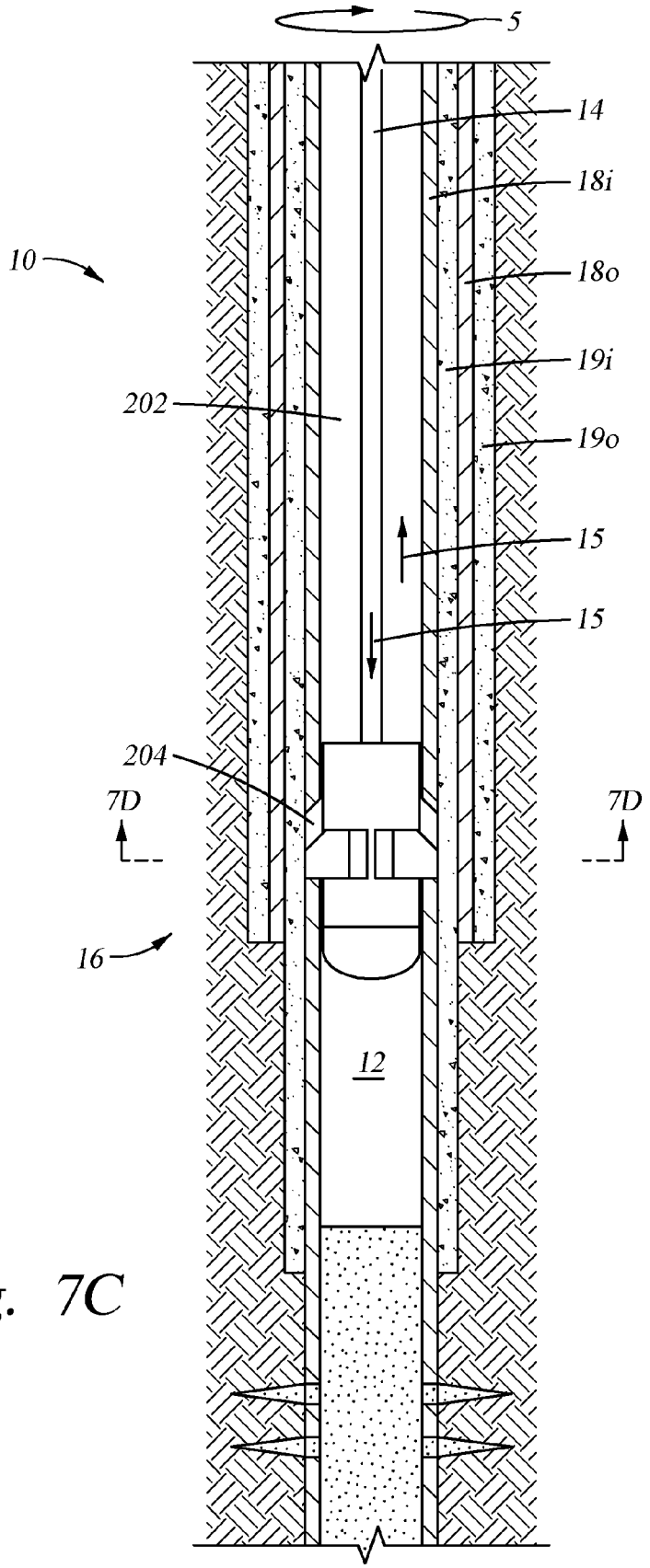
Figure 7D:
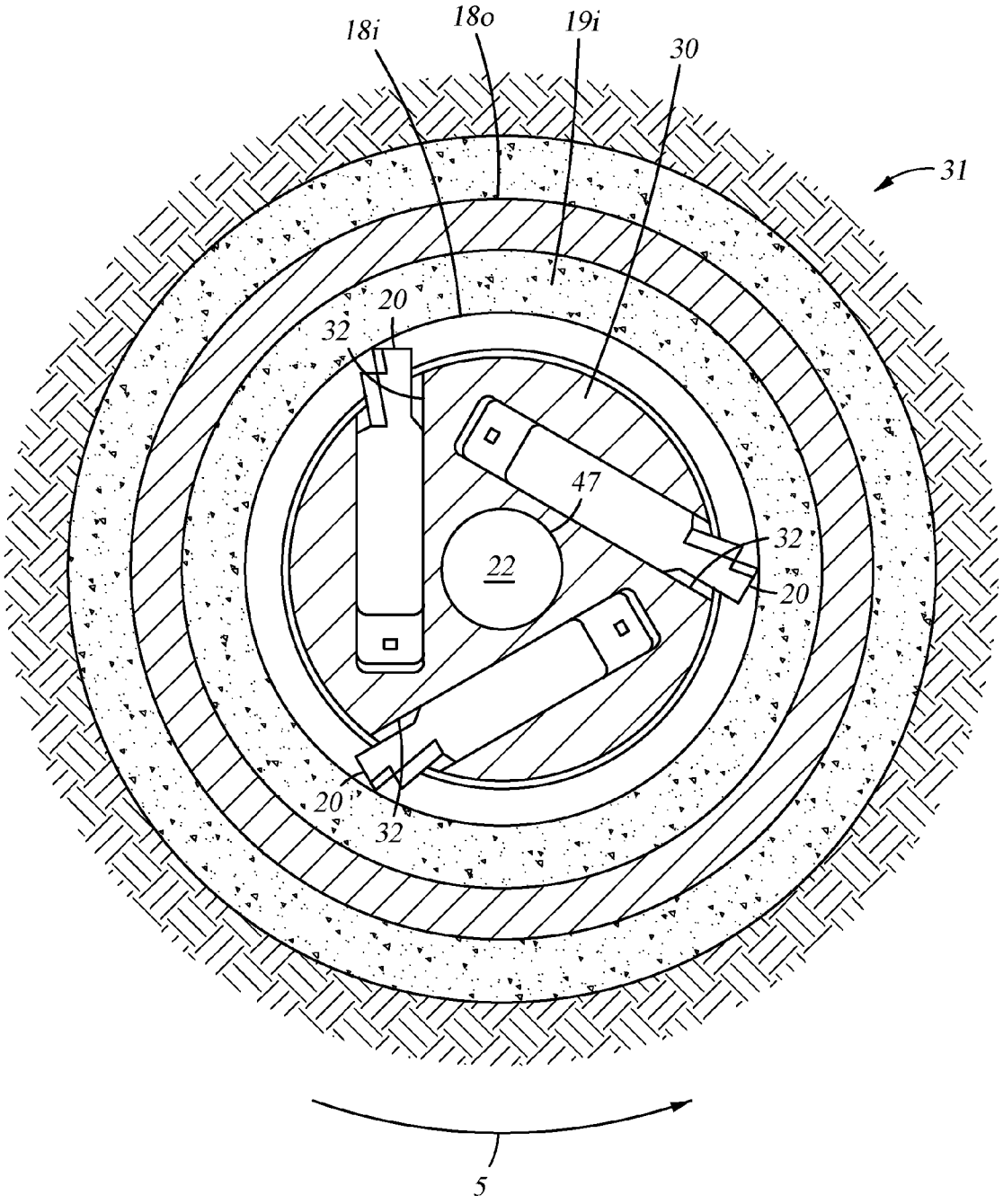

The BHA 16 continues to rotate as the blades 20 extend into the inner tubular 18*i*, as shown in FIGS. 7A and 7B. After engaging the inner tubular 18*i*, the epoxy coating 56 at least partially wears away. As the blade 20 continues to extend, the blade 20 cuts laterally outwards and/or axially upwards through the inner tubular 18*i*, for example using the trailing and intermediate cutting structures 68*a*, 68*b*. In one embodiment, an outer-facing edge of the trailing cutting structure 68*a* forms a leading cutting edge while the blade 20 cuts laterally outwards and/or axially upwards. In another embodiment, an outer-facing edge of the intermediate cutting structure 68*b* forms the leading cutting edge. In yet another embodiment, the outer-facing edges of both the trailing cutting structure 68*a* and the intermediate cutting structure 68*b* form the leading cutting edge. Meanwhile, milling fluid may be circulated through the conveyor string 14 and the BHA 16 and up an annulus 202 between the conveyor string 14 and the inner tubular 18*i*, as shown by arrows 15. A portion of the milling fluid may be diverted into the pocket 32 via the upper block 34 in order to remove the segments of tubular cuttings cut by the intermediate cutting structure 68*b*. The BHA 16 may be held longitudinally in place during the lateral cut-through operation. A supply pressure gauge may be monitored to determine when the blade 20 has cut through the inner tubular 18*i* as indicated by an increase in pressure caused by engagement of the blade 20 with the stop 42. The cut in the inner tubular 18*i* forms the window 204, as shown in FIG. 7C. In one embodiment, the integral stabilizer 52 engages the inner tubular 18*i* after the blade 20 cuts through the inner tubular 18*i*. As a result, the integral stabilizer 52 prevents further extension of the blade 20, thereby limiting the depth of cut. In another embodiment, the stop 42 prevents further extension of the blade 20, thereby limiting the depth of cut. The integral stabilizer 52 and/or the stop 42 may prevent the blade 20 from damaging the outer tubular 18*o* by limiting the depth of cut.

The window 204 may extend entirely around and through the inner tubular 18*i*, thereby separating the inner tubular 18*i* between an upper and lower section. The blade 20 is positioned in the window 204 such that the leading cutting structure 68*c* engages a wall thickness of the lower section of inner tubular 18*i*. Thereafter, weight may be set down on the BHA 16. The BHA 16 then longitudinally extends the window 204 by cutting the inner tubular 18*i* using the leading cutting structure 68*c*. A bottom edge of the leading cutting structure 68*c* thereby forms a leading cutting edge while the blade 20 longitudinally extends the window 204. In one embodiment, the window 204 is formed in a tubular coupling of the inner tubular 18*i*, and the blade 20 is positioned such that the intermediate cutting structure 68*b* engages a thickness of a lower section of the tubular coupling. Thereafter, the BHA 16 longitudinally extends the window 204 by cutting the inner tubular 18*i* and the tubular coupling using the intermediate cutting structure 68*b* and the leading cutting structure 68*c*. In this embodiment, both the intermediate cutting structure 68*b* and the leading cutting structure 68*c* form the leading face. Meanwhile, the integral stabilizer 52 engages the inner surface of the inner tubular 18*i*, thereby stabilizing the BHA 16. In one embodiment, the integral stabilizer 52 remains engaged with the inner tubular 18*i* while the BHA 16 rotates. Axial downward advancement of the BHA 16 may continue until the cutting portion 50 is exhausted. For example, torque exerted by the top drive may be monitored to determine when the cutting portion 50 has become exhausted. In some embodiments, rather than advancing the BHA 16 downward to longitudinally extend the window 204, the BHA 16 may move upwards. In such embodiments, rotation 5 and configuration of the cutter assembly 31 may be reversed (right-hand drive to left-hand drive) to prevent loosening of threaded connections in the conveyor string 14.

While the operation of the BHA 16 is described with regard to cutting the inner tubular 18*i*, a similar operation may be performed to cut the outer tubular 18*o* by extending the blade 20 further outward to cut the outer tubular 18*o*.

Figure 8:
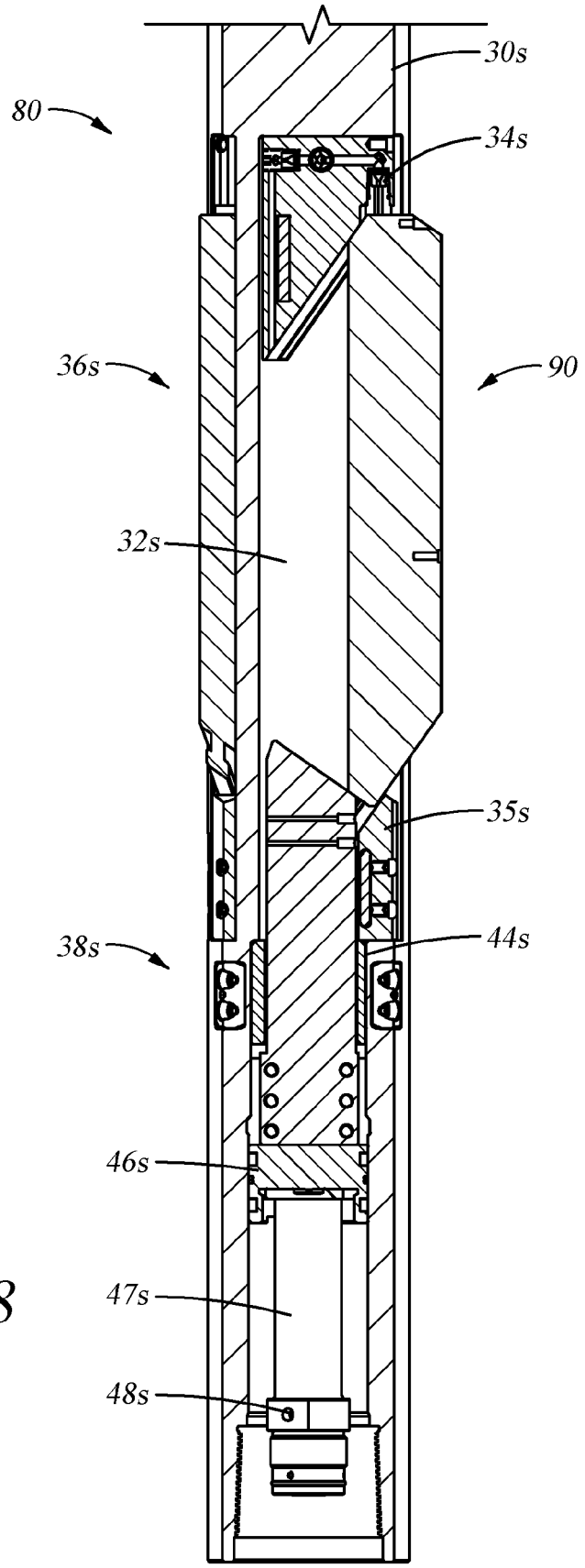
FIG. 8 illustrates an optional stabilizer assembly for use with the system of FIG. 1, according to another embodiment of the present disclosure.

FIG. 8 illustrates a rotatable stabilizer assembly 80 for use with a second BHA 300, according to another embodiment. In one embodiment, the stabilizer assembly 80 and the cutter assembly 31 are substantially similarly constructed. For convenience, components in the stabilizer assembly 80 that are similar to components in the cutter assembly 31 have the same reference indicator and an "s," indicating the component belongs to the stabilizer assembly 80. When engaged with an inner wall of the inner tubular 18*i*, stabilizer assembly 80 does not cut the inner tubular 18*i*.

The stabilizer assembly 80 includes a housing 30*s* with a stabilizer blade portion 36*s* and a stabilizer actuator portion 38*s*. The stabilizer blade portion 36*s* includes an upper block 34*s*, a lower block 35*s*, and a stabilizer blade 90 disposed in a pocket 32*s*. The stabilizer blade 90 is movable between a retracted position (not shown) and an extended position (FIGS. 8 and 10-13). The stabilizer blade 90 is disposed in the pocket 32*s* in the retracted position and at least a portion of the stabilizer blade 90 extends from the pocket 32*s* in the extended position. In one embodiment, the stabilizer assembly 80 includes a plurality of stabilizer blades 90 in respective pockets 32*s*, as shown in FIG. 11. The pockets 32*s* may be eccentrically arranged relative to the housing 30*s*, and each stabilizer blade 90 may have an eccentric extension path relative to the housing 30*s*, resulting in a far-reaching available sweep.

The stabilizer actuator portion 38*s* includes an actuator arm 44*s* in a chamber 46*s* formed between the housing 30*s* and a mandrel 47*s* in the housing bore. The actuator arm 44*s* seals the chamber 46*s* between an upper portion and a lower portion. In one embodiment, the upper portion is in fluid communication with the pocket 32*s*. The lower portion of the chamber 46*s* is in fluid communication with the housing bore via a port 48*s* in the mandrel 47*s* and the wall of the housing 30. The actuator arm 44*s* is movable between an upper position and a lower position. The actuator arm 44*s* may initially be restrained in the lower position by a second set of one or more shear pins. For example, a pressure differential between fluid pressure in the housing bore and fluid pressure in the pocket 32*s* may exert a net upward actuation force on the actuator arm 44*s* when milling fluid is pumped through the housing 30*s*. Collectively, the second set of shear pins may fasten the actuator arm 44*s* to the housing 30*s* until the upward actuation force reaches a second shear force necessary to fracture the second set of shear pins and release the actuator arm 44*s* from the lower position. In one embodiment, the upper actuation force in the housing 30 is effectively equal to the upper actuation force in the housing 30*s*. The upper actuation force may increase as an injection rate of milling fluid through the housing 30*s* is increased until the injection rate reaches a second activation threshold equal to the second shear force, thereby releasing the actuation arm 44*s* from the lower position. The second shear force and second activation threshold may be less than those of the cutter assembly 31 such that the stabilizer blade 90 extends before the blade 20. In one embodiment, the actuator arm 44*s* includes a tapered upper surface for engaging a tapered lower surface of the stabilizer blade 90. By releasing the actuator arm 44*s* from the lower position, the actuator arm 44*s* moves upward and acts on the stabilizer blade 90, thereby causing the stabilizer blade 90 to extend. For example, the tapered upper surface on the actuator arm 44*s* acts on the tapered lower surface of the stabilizer blade 90 to extend the stabilizer blade 90.

In some embodiments, an electronics package may operate actuator arm 44*s*. For example, the second set of shear pins may be replaced by a locking mechanism. In response to an electronic signal, locking mechanism may release the actuator arm 44*s* from the lower position. The electronic signal may be transmitted through wired or wireless communication, and an RFID tag may be used to send the electronic signal.

Figure 9:
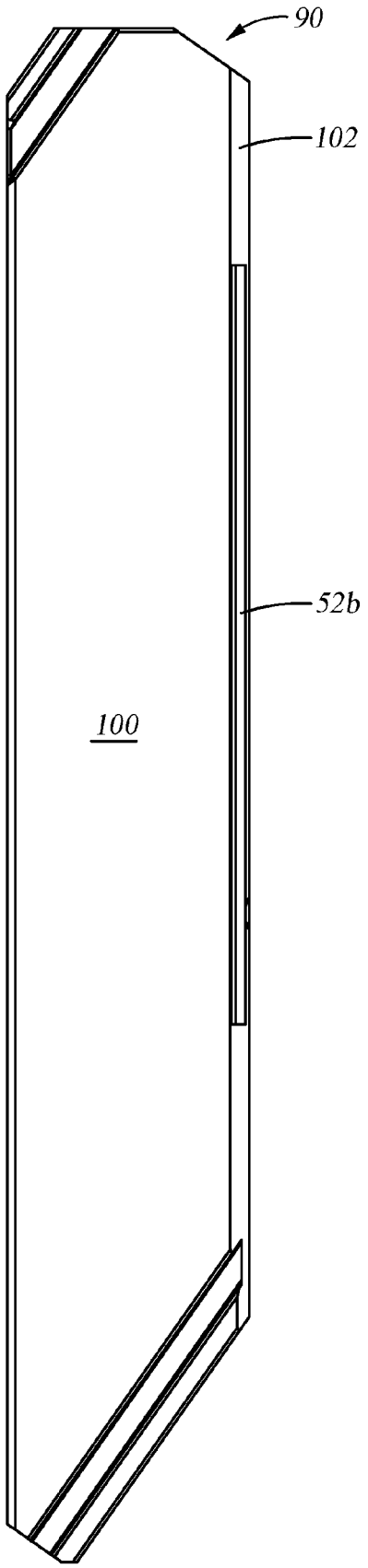
FIG. 9 illustrates an exemplary embodiment of a stabilizer blade of the stabilizer assembly of FIG. 8.

FIG. 9 illustrates an exemplary embodiment of the stabilizer blade 90. The stabilizer blade 90 includes a stabilizer body 100. The stabilizer body 100 may include upper and lower tapered ends for engaging the upper and lower blocks 34*s*, 35*s*, respectively. The stabilizer body 100 may also include a ramp for interaction with the actuator arm 44*s*. An upper end of an outer portion of the stabilizer body 100 may be inclined for serving as a retraction profile. The stabilizer blade 90 may include a stabilizer 52*s* bonded to an outer surface 102 of the stabilizer body 100. The outer surface 102 may be made up of one or more planes, similar to outer surface 66. Engagement between the stabilizer 52*s* and the tubular 18 may stabilize the second BHA 300 without cutting the tubular 18. Stabilizer blade 90 with stabilizer 52*s* may be more or less durable than cutter blade 20 with cutting portion 50 and integral stabilizer 52. During operations, BHA 300 may be configured to provide desired useful lifetimes for each of cutter blade 20, cutting portion 50, stabilizer blade 90, integral stabilizer 52, and stabilizer 52*s*. In some operations, cutter assembly 31 or stabilizer assembly 80 may be actuated at different times to manage useful lifetimes of the components. Refurbishing of cutter assembly 31 and stabilizer assembly 80 may be set on different lifecycles to accommodate the various useful lifetimes of the components.

The stabilizer 52*s* may be made from a matrix of composite material bonded to the body 100 by a metallurgical bond, such as by plasma arc welding, laser cladding, or any other suitable hard banding process. It is currently believed that such metallurgical bond may significantly reduce heat input to and/or warpage of the stabilizer 52. In one embodiment, the composite material includes Teflon and/or a hard-facing alloy, such as tungsten carbide. In one embodiment, the composite material is disposed onto the outer surface 102 in layers. In one embodiment, the composite material does not require preheating before being bonded to the outer surface 102. The composite material may be applied to the outer surface 102 by applying localized heat to the stabilizer blade 90. Multiple layers of the composite material may be added to the outer surface 102, thereby forming a desired profile of the stabilizer 52*s*, as described herein. In one embodiment, the stabilizer 52*s* includes a rounded profile conforming to the inner surface of the tubular 18. In another embodiment, the stabilizer 52*s* includes a flat profile. In one embodiment, the flat stabilizer 52*s* may be altered to have the rounded profile, such as by grinding the stabilizer 52*s*. In another embodiment, the flat stabilizer 52*s* becomes round during use of the second BHA 300, such as by rotating the stabilizer assembly 80 and engaging the flat profile of the stabilizer 52*s* with the tubular 18. In turn, the stabilizer 52*s* may conform to the inner surface of the tubular 18, as described herein. The stabilizer 52*s* may have an adjustable thickness for use with various tubular thicknesses and for various weights of BHA 300. The thickness of the stabilizer 52*s* is increased by applying more layers of the composite material. The thickness of the stabilizer 52*s* may be selected such that a sweep of the stabilizer 52*s* is between the drift diameter and the nominal inner diameter of the tubular 18.

Figure 10:
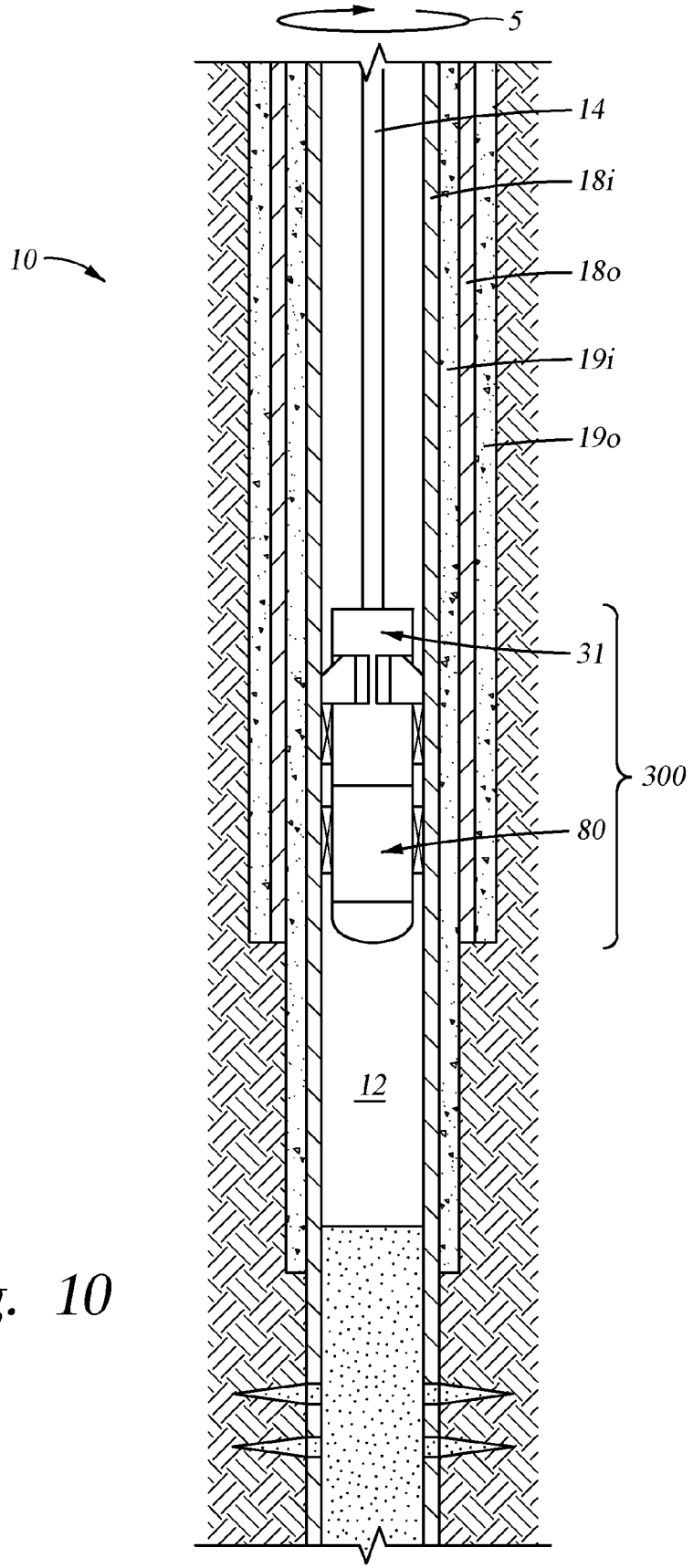
FIGS. 10-14 illustrate exemplary operations of the stabilizer assembly of FIG. 8 with the cutter assembly of FIG. 1.
Figure 11:
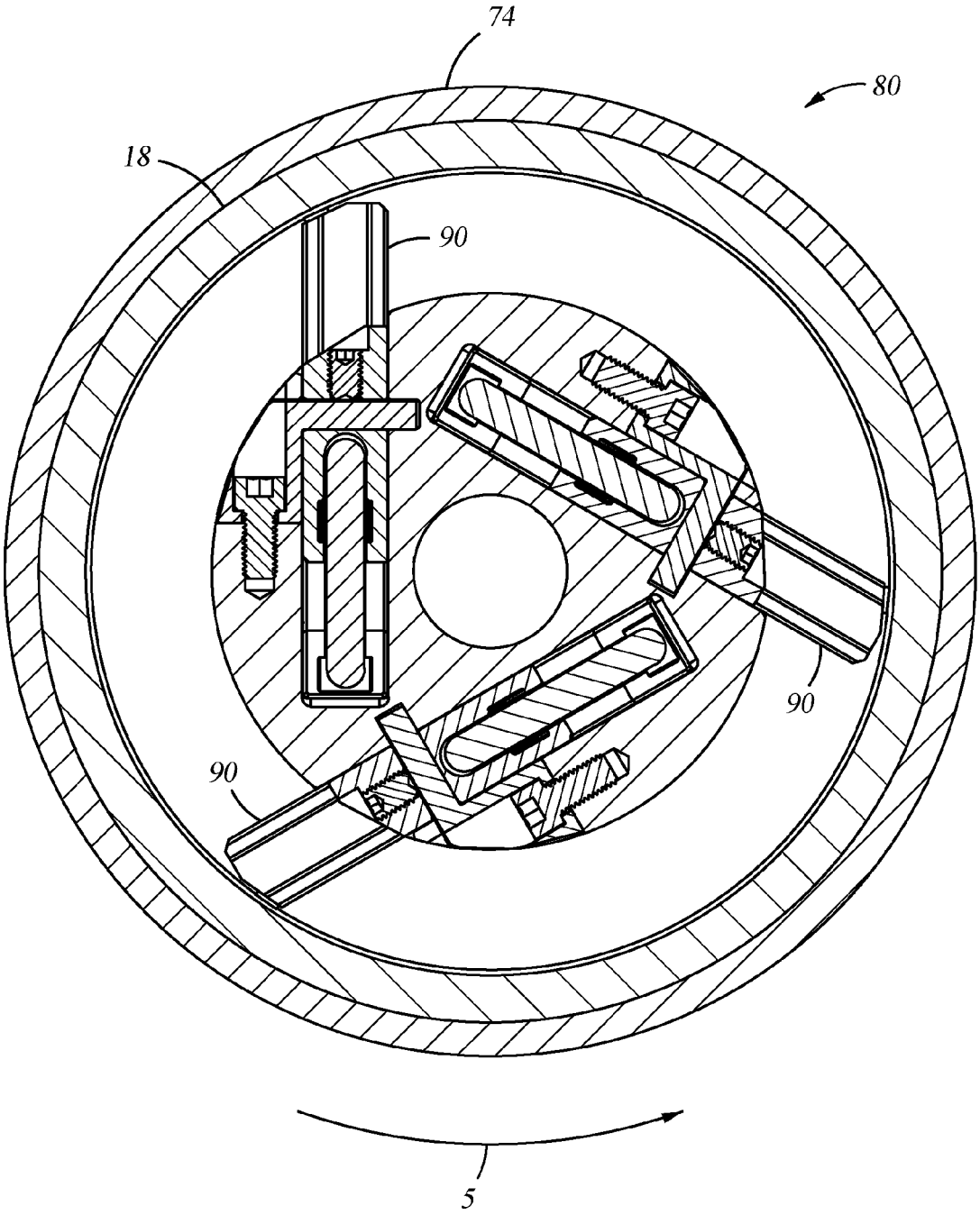

FIGS. 10-13 illustrate operation of the stabilizer assembly 80 with the cutter assembly 31. The stabilizer assembly 80 may be operatively attached to the cutter assembly 31 to form second BHA 300. The second BHA 300 may be assembled and deployed into the inner tubular 18*i* using the conveyor string 14, as shown in FIG. 10. During deployment of the second BHA 300, milling fluid may be circulated by the mud pump at a flow rate less than the second activation threshold. The second BHA 300 is rotated (direction shown by arrow 5), and injection of the milling fluid is increased to at least the second activation threshold, thereby releasing the actuator arm 44*s* and extending the stabilizer blade 90 into engagement with the inner surface of the inner tubular 18*i*.

Figure 12:
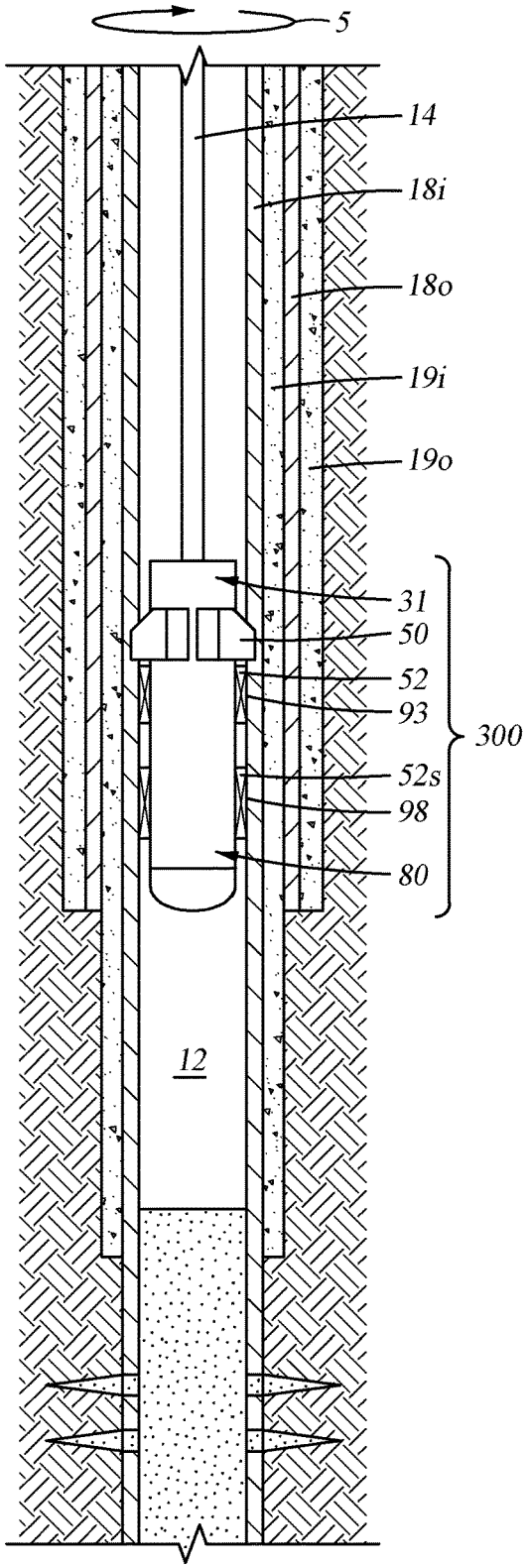
Figure 13:
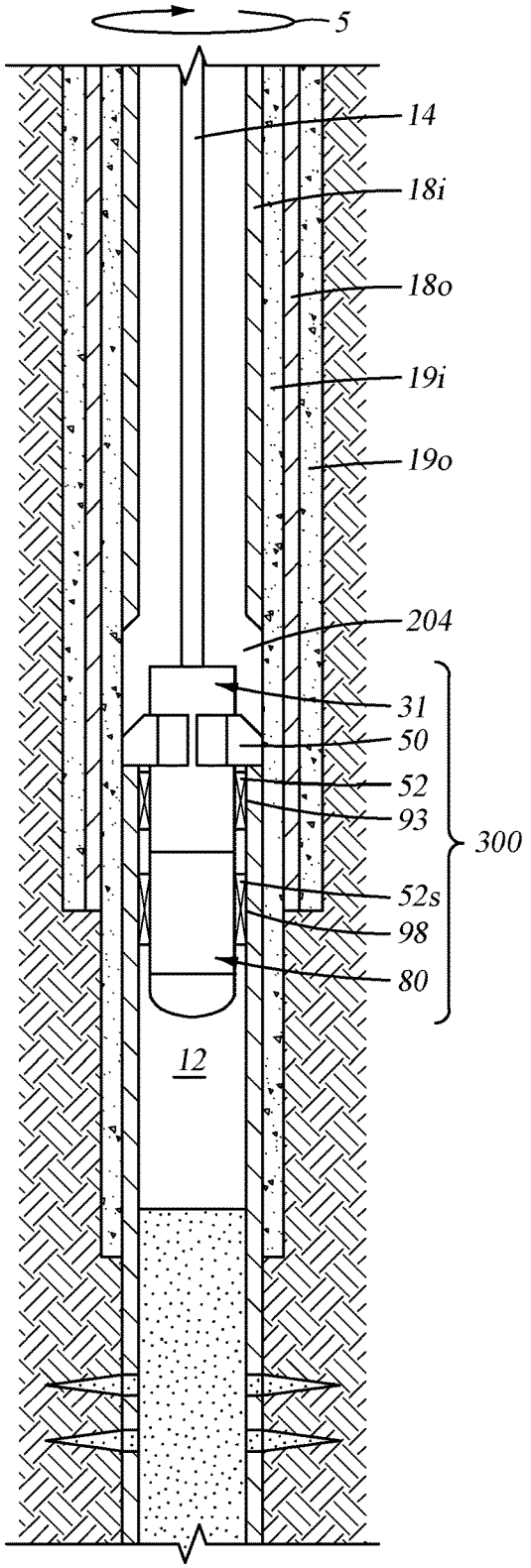

Thereafter, the injection of the milling fluid is increased to at least the activation threshold of the actuation arm 44, thereby releasing and extending the blade 20 into engagement with the inner surface of the inner tubular 18*i*, as shown in FIG. 12. The window 204 may then be opened and extended, as shown in FIG. 13. Extension of the window 204 may continue until a desired window size is achieved, and/or until the blade 20 is exhausted. The stabilizer blade 90 may remain engaged with the inner tubular 18*i* (without cutting the inner tubular 18*i*) while the window 204 is opened and extended. Engagement of the stabilizer 52*s* with the inner tubular 18*i* may center the second BHA 300 within the inner tubular 18*i*, minimize or eliminate excess movement or play, allow the second BHA 300 to rotate freely within the inner tubular 18*i*, and/or allow rotation of the second BHA 300 within the inner tubular 18*i* while limiting radial movement therein. As illustrated in FIG. 12, engagement of the integral stabilizer 52 with the inner tubular 18*i* provides a first stabilization surface 93, and engagement of the stabilizer 52*s* with the inner tubular 18*i* provides a second stabilization surface 98. Having two axially-separated stabilization surfaces, BHA 300 may have greater longitudinal stabilization than BHA's with only a single stabilization surface.

Figure 14A:
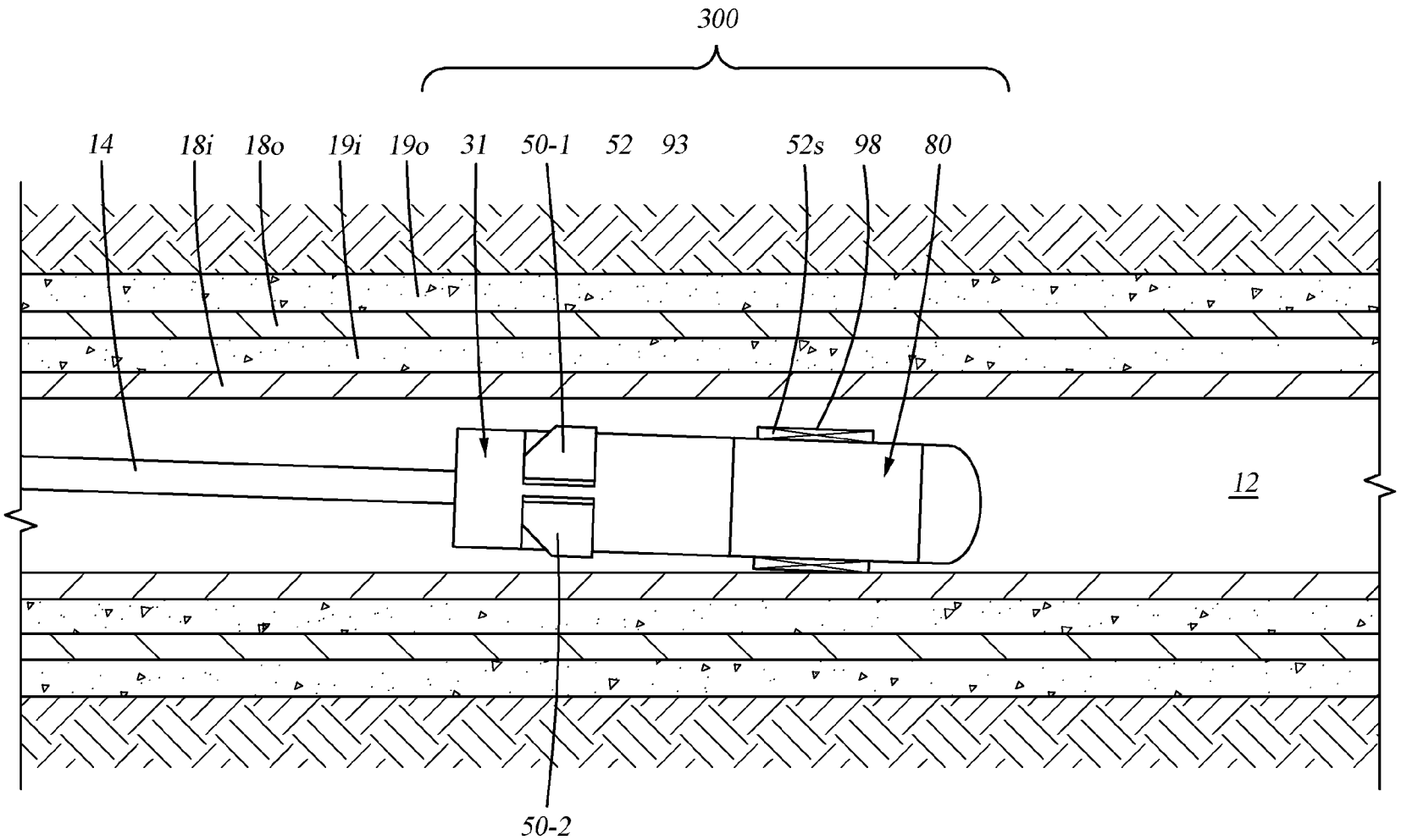
Figure 14B:
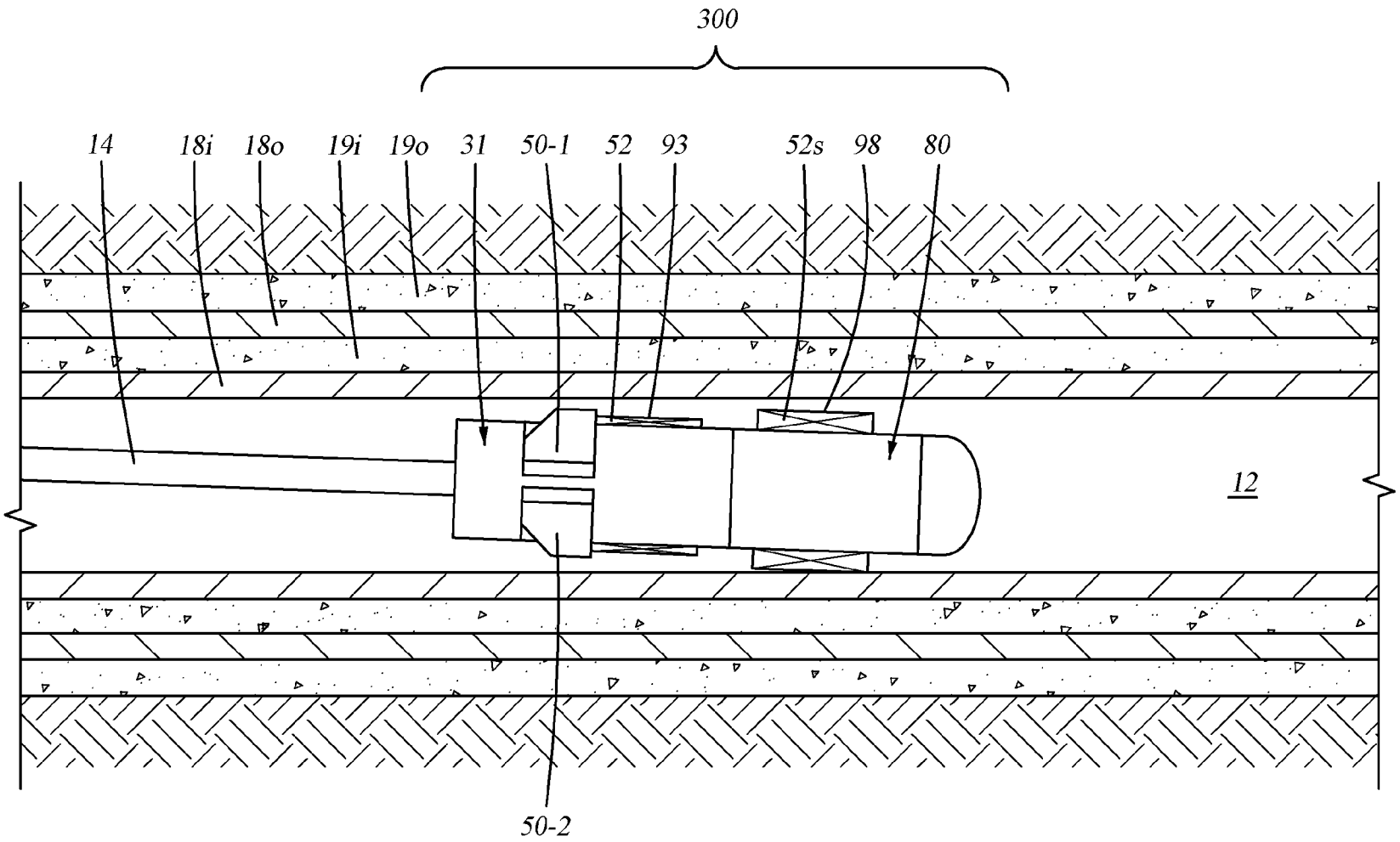
Figure 14C:
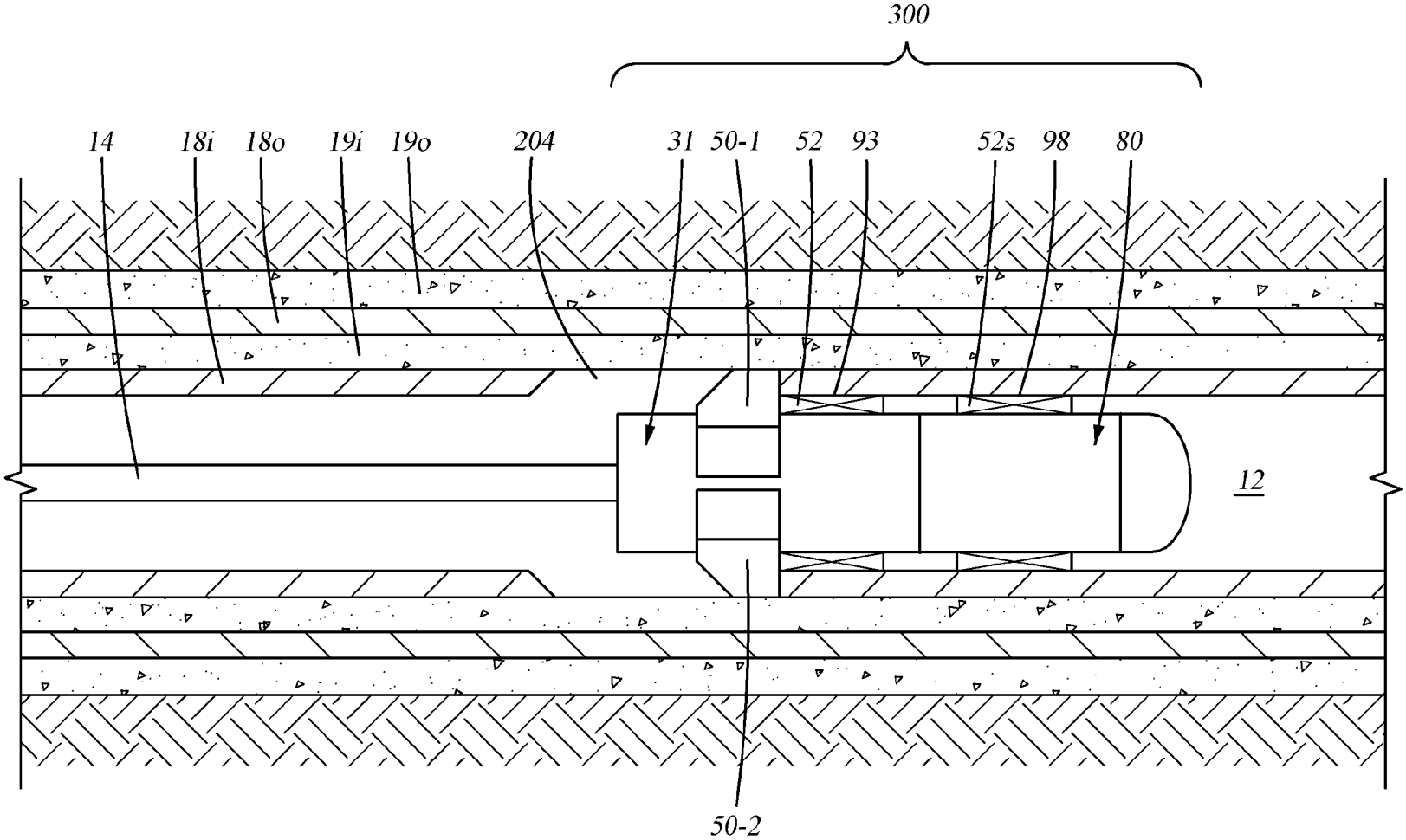

More than one stabilization surface may be advantageous in operations having deviated or horizontal wellbores. For example, as illustrated in FIGS. 14A-C, BHA 300 may benefit from multiple stabilization surfaces when operating in a horizontal wellbore 12. Gravity may operate to laterally displace BHA 300 in horizontal wellbore 12, making the longitudinal axis of BHA 300 not parallel with the longitudinal axis of inner tubular 18*i*, and/or making BHA 300 not coaxial with (not centralized in) tubular 18*i*. FIG. 14A shows one cutting portion 50-2 engaged with a gravitationally-lower inner surface of inner tubular 18*i*, while another cutting portion 50-1 is not at all engaged with inner tubular 18*i*. Such configuration may occur if only cutter assembly 31 is actuated to extend blades 20 with cutting portions 50. As both cutter assembly 31 and stabilizer assembly 80 are actuated in FIG. 14B, integral stabilizers 52 (of cutter assembly 31) and stabilizers 52*s* (of stabilizer assembly 80) begin to engage inner tubular 18*i*, making the longitudinal axis of BHA 300 more parallel and coaxial with the longitudinal axis of tubular 18*i*. In FIG. 14C, integral stabilizers 52 (of cutter assembly 31) are engaged with inner tubular 18*i* at stabilization surface 93, and stabilizers 52*s* (of stabilizer assembly 80) are engaged with inner tubular 18*i* at stabilization surface 98. Both cutting portion 50-1 and cutting portion 50-2 are engaged with inner tubular 18*i*, initiating a window cutting. The weight of BHA 300 is distributed across the gravitationally-lower portions of stabilization surface 93 and stabilization surface 98. BHA 300 may therefore be gravitationally supported in horizontal wellbore 12 by stabilization surface 93 and stabilization surface 98 while cutting inner tubular 18*i*.

While the operation of the second BHA 300 is described with regard to cutting the inner tubular 18*i*, a similar operation may be performed to cut the outer tubular 18*o* by extending the stabilizer blade 90 and the blade 20 further outward.

In one embodiment, a method of cutting a tubular includes lowering a rotatable cutting tool in the tubular, the cutting tool includes a blade having a cutter portion; engaging the tubular using a first cutting structure row of the cutter portion; engaging the tubular using a second cutting structure row of the cutter portion while the first cutting structure row engages the tubular; forming a window in the tubular; and axially extending the window using a third cutting structure row of the cutter portion, wherein the third cutting structure row is configured to engage an exposed wall thickness of the tubular.

In one or more of the embodiments described herein, the method includes engaging the tubular using a stabilizer portion of the blade.

In one or more of the embodiments described herein, the window is formed by extending the blade relative to the cutting tool.

In one or more of the embodiments described herein, the window is formed by extending the blade both radially outward and axially upward.

In one or more of the embodiments described herein, the first cutting structure row includes crushed carbide.

In one or more of the embodiments described herein, the second and third cutting structure rows each include carbide inserts.

In one or more of the embodiments described herein, the third cutting structure row engages the exposed wall thickness after the second cutting structure row engages the tubular.

In one or more of the embodiments described herein, the method includes breaking tubular cutting segments using the second cutting structure row while extending the blade.

In one or more of the embodiments described herein, breaking tubular cutting segments includes changing a contact surface between the second cutting structure row and the tubular.

In one or more of the embodiments described herein, the method includes axially extending the window in the tubular using both the second cutting structure row and the third cutting structure row of the cutter portion.

In one or more of the embodiments described herein, the method includes stabilizing the cutting tool by engaging the tubular using the stabilizer portion.

In one or more of the embodiments described herein, the method includes controlling a depth of cut of the cutting tool by engaging the tubular using the stabilizer portion.

In one or more of the embodiments described herein, the stabilizer portion is integral to the blade.

In one or more of the embodiments described herein, the method includes limiting extension of the blade by engaging the tubular using the stabilizer portion.

In one or more of the embodiments described herein, the stabilizer portion includes a composite material metallurgical bonded to the blade using plasma arc welding and/or laser cladding.

In one or more of the embodiments described herein, the stabilizer portion stabilizes the tool while axially extending the window in the tubular.

In one or more of the embodiments described herein, the composite material includes tungsten carbide.

In one or more of the embodiments described herein, the method includes increasing the rate of cutting of the blade by engaging the tubular using a tapered outer surface of the cutter portion.

In one or more of the embodiments described herein, the method includes minimizing chatter and/or stalling of the blade by engaging the tubular using a tapered outer surface of the cutter portion.

In one or more of the embodiments described herein, the method includes increasing the rate of cutting of the blade by engaging the tubular using a tapered lower surface of the cutter portion.

In one or more of the embodiments described herein, the method includes cushioning an impact when the first cutting structure row engages the tubular.

In one or more of the embodiments described herein, the impact is cushioned using a wearable coating on the first cutting structure row.

In another embodiment, a rotatable blade for cutting a tubular includes a blade body extendable from a retracted position; and a cutter portion on the blade body having: a first cutting structure row configured to engage the tubular, a second cutting structure row configured to engage the tubular while the first cutting structure row engages the tubular, and a third cutting structure row configured to engage an exposed wall thickness of the tubular.

In one or more of the embodiments described herein, the blade including a stabilizer structure disposed on an outer surface of the blade body, the stabilizer structure having at least one layer of composite material that provides a surface contact between the stabilizer structure and the tubular.

In one or more of the embodiments described herein, the second cutting structure row is disposed on a first leading face of the cutter portion and the third cutting structure row is disposed on a second leading face of the cutter portion.

In one or more of the embodiments described herein, the first cutting structure row is suitable for cutting the tubular in both an axially upward and radially-outward direction.

In one or more of the embodiments described herein, the second cutting structure row is suitable for cutting the tubular in both an axially upward and radially-outward direction.

In one or more of the embodiments described herein, the stabilizer structure is bonded to the outer surface of the blade body using plasma arc welding and/or laser cladding.

In one or more of the embodiments described herein, the stabilizer structure is configured to control a depth of cut of the cutter portion.

In one or more of the embodiments described herein, the stabilizer structure is configured to stabilize the blade.

In one or more of the embodiments described herein, the cutter portion includes a wearable coating configured to cushion an impact between the blade and the tubular.

In one or more of the embodiments described herein, the first cutting structure row includes crushed carbide.

In one or more of the embodiments described herein, the second cutting structure row includes a plurality of carbide inserts.

In one or more of the embodiments described herein, each of the plurality of carbide inserts include at least five sides.

In one or more of the embodiments described herein, each of the plurality of carbide inserts are circularly shaped.

In one or more of the embodiments described herein, the third cutting structure row includes a plurality of carbide inserts configured to extend a window formed in the tubular.

In one or more of the embodiments described herein, each of the plurality of carbide inserts include four sides.

In one or more of the embodiments described herein, a first carbide insert is in contact with a second carbide insert, thereby forming a seam line at an interface therebetween.

In one or more of the embodiments described herein, the seamline is aligned with a second seamline formed by a third carbide insert and a fourth carbide insert, whereby the seamline and the second seamline form a continuous seamline between the first and second carbide inserts and the third and fourth carbide inserts.

In one or more of the embodiments described herein, the seamline is misaligned with a second seamline formed by a third carbide insert and a fourth carbide insert.

In one or more of the embodiments described herein, the seamline is at a vertical interface therebetween.

In one or more of the embodiments described herein, the seamline is at a horizontal interface therebetween.

In one or more of the embodiments described herein, a side of the first carbide insert contacts effectively an entire side of the second carbide insert, thereby minimizing a space therebetween.

In one or more of the embodiments described herein, the cutter portion includes a radially outward taper from a top of the cutter portion to a bottom of the cutter portion, the taper being configured to increase cutting pressure against the tubular.

In one or more of the embodiments described herein, the taper ranges from 3 degrees to 20 degrees relative to a vertical axis.

In another embodiment, a tool for cutting a tubular includes a plurality of blades, each blade having: a first cutting structure row and a second cutting structure row both suitable for cutting the tubular in a radially-outward direction, and a third cutting structure row suitable for cutting the tubular in an axial direction.

In one or more of the embodiments described herein, the tool includes a stabilizer structure disposed on an outer surface of each blade, the stabilizer structure having at least one layer of a composite material that provides a surface contact between the stabilizer structure and the tubular.

In one or more of the embodiments described herein, the first cutting structure row includes crushed carbide.

In one or more of the embodiments described herein, the second cutting structure row includes carbide inserts configured to break tubular cuttings into smaller segments.

In one or more of the embodiments described herein, the third cutting structure row includes a plurality of carbide inserts configured to extend a window formed in the tubular.

In one or more of the embodiments described herein, a first blade of the plurality of blades includes a first carbide insert in contact with a second carbide insert, thereby forming a seamline therebetween.

In one or more of the embodiments described herein, a second blade of the plurality of blades includes a corresponding seamline formed by a third carbide insert and a fourth carbide insert, wherein the seamline on the first blade and the seamline on the second blade are staggeredly arranged.

In another embodiment, a rotatable blade for cutting a tubular includes a blade body extendable from a retracted position; and a cutter portion on the blade body having: a first plurality of cutting structures configured in a first arrangement, and a second plurality of cutting structures configured in a second arrangement different from the first arrangement.

In one embodiment, a method of cutting a tubular includes disposing a rotatable cutter assembly in the tubular, the cutter assembly including a blade having a cutting portion; engaging the tubular using a trailing cutting structure of the cutting portion; engaging the tubular using an intermediate cutting structure of the cutting portion; forming a window in the tubular; and longitudinally extending the window using a leading cutting structure of the cutting portion.

In one or more of the embodiments described herein, the engaging the tubular using an intermediate cutting structure of the cutting portion occurs while the trailing cutting structure engages the tubular.

In one or more of the embodiments described herein, the window is formed by at least one of the engaging the tubular using a trailing cutting structure of the cutting portion, and the engaging the tubular using an intermediate cutting structure of the cutting portion.

In one or more of the embodiments described herein, the window is formed by extending the blade both laterally outward and axially upward.

In one or more of the embodiments described herein, the leading cutting structure is configured to engage an exposed wall thickness of the tubular.

In one or more of the embodiments described herein, the leading cutting structure engages the exposed wall thickness after the intermediate cutting structure engages the tubular.

In one or more of the embodiments described herein, the method also includes engaging the tubular using an integral stabilizer portion of the blade.

In one or more of the embodiments described herein, the engaging the tubular using the integral stabilizer portion of the blade includes at least one of: stabilizing the cutter assembly, controlling a depth of cut of the cutter assembly, and limiting extension of the blade.

In one or more of the embodiments described herein, the method also includes cushioning an impact when the trailing cutting structure engages the tubular.

In one or more of the embodiments described herein, the impact is cushioned using a wearable coating on the trailing cutting structure.

In one or more of the embodiments described herein, the method also includes operating an actuator to extend the blade from a retracted position to an extended position, wherein the actuator is at least one of hydraulic and electric.

In one or more of the embodiments described herein, the actuator is signaled with an RFID tag.

In another embodiment, a rotatable blade for cutting a tubular includes a blade body extendable from a retracted position; and a cutting portion on the blade body having: a trailing cutting structure configured to engage the tubular, a intermediate cutting structure configured to engage the tubular while the trailing cutting structure engages the tubular, a leading cutting structure configured to engage an exposed wall thickness of the tubular; and an integral stabilizer disposed on at least a portion of an outer surface of the blade body.

In one or more of the embodiments described herein, the integral stabilizer includes a composite material metallurgical bonded to the blade.

In one or more of the embodiments described herein, the intermediate cutting structure is disposed on a first leading face of the cutting portion, and the leading cutting structure is disposed on a second leading face of the cutting portion.

In one or more of the embodiments described herein, the first leading face of the cutting portion has an attack angle ranging from −10 degrees to +10 degrees relative to a reference plane.

In one or more of the embodiments described herein, the trailing cutting structure is configured to cut the tubular in both an axially upward and a laterally outward directions.

In one or more of the embodiments described herein, the cutting portion includes a wearable coating configured to cushion an impact between the blade and the tubular.

In one or more of the embodiments described herein, the trailing cutting structure includes at least one of crushed carbide and an epoxy coating.

In one or more of the embodiments described herein, at least one of the intermediate cutting structure and the leading cutting structure includes a plurality of chip breaker inserts.

In one or more of the embodiments described herein, a cross-section of at least one of the plurality of chip breaker inserts is either circular or polygonal with at least five sides.

In one or more of the embodiments described herein, at least one of the intermediate cutting structure and the leading cutting structure includes carbide inserts.

In one or more of the embodiments described herein, the carbide inserts are configured to have negative rake angles when cutting axially downward.

In one or more of the embodiments described herein, the leading cutting structure includes a plurality of carbide inserts configured to extend a window formed in the tubular.

In one or more of the embodiments described herein, a first carbide insert is in contact with a second carbide insert, thereby forming a seam line at an interface therebetween.

In one or more of the embodiments described herein, the seamline is aligned with a second seamline formed by a third carbide insert and a fourth carbide insert, whereby the seamline and the second seamline form a continuous seamline between the first and second carbide inserts and the third and fourth carbide inserts.

In one or more of the embodiments described herein, the seamline is misaligned with a second seamline formed by a third carbide insert and a fourth carbide insert.

In one or more of the embodiments described herein, the seamline is at a vertical interface therebetween.

In one or more of the embodiments described herein, the seamline is at a horizontal interface therebetween.

In one or more of the embodiments described herein, a side of the first carbide insert contacts effectively an entire side of the second carbide insert, thereby minimizing a space therebetween.

In one or more of the embodiments described herein, the cutting portion includes an outer surface having an outer taper outwardly from a top of the cutting portion to a bottom of the cutting portion.

In one or more of the embodiments described herein, the outer taper ranges from 3 degrees to 20 degrees relative to a vertical axis.

In one or more of the embodiments described herein, the cutting portion includes a second outer surface including a second outer taper outwardly from the top of the cutting portion to the bottom of the cutting portion, wherein the second outer taper differs from the outer taper.

In one or more of the embodiments described herein, the cutting portion includes a bottom surface having a bottom taper upwardly from the outer surface of the blade body to the outer surface of the cutting portion.

In one or more of the embodiments described herein, the bottom taper ranges from 0 degrees to 8 degrees relative to a horizontal axis.

In another embodiment, a bottom hole assembly for cutting a tubular includes a cutter assembly; and a stabilizer assembly including: a housing that is rotatable relative to the tubular; a stabilizer blade having an eccentric extension path relative to the housing; and an actuation mechanism for extending the stabilizer blade from a retracted position to an extended position, wherein the stabilizer blade in the extended position engages an inner wall of the tubular without cutting the tubular.

In one or more of the embodiments described herein, the stabilizer blade including: a stabilizer body; and a stabilizer bonded to an outer surface of the stabilizer body.

In one or more of the embodiments described herein, the stabilizer includes a composite material metallurgical bonded to the blade.

In one or more of the embodiments described herein, the cutter assembly includes: a housing that is rotatable relative to the tubular; a blade having an eccentric extension path relative to the housing; and an actuation mechanism for extending the blade from a retracted position to an extended position, wherein the blade in the extended position engages the tubular to cut the tubular.

In one or more of the embodiments described herein, the blade includes: a blade body extendable from the retracted position; and a cutting portion on the blade body having: a trailing cutting structure configured to engage the tubular while the blade extends both laterally outward and axially upward; an intermediate cutting structure configured to engage the tubular at least laterally outward; a leading cutting structure configured to engage an exposed wall thickness of the tubular; and an integral stabilizer disposed on at least a portion of an outer surface of the blade body.

In another embodiment, a method of cutting a tubular includes disposing a rotatable cutter assembly in the tubular, the cutter assembly including a first stabilization surface; disposing a rotatable stabilizer assembly in the tubular, the stabilizer assembly including a second stabilization surface; and engaging the tubular with the first and second stabilization surfaces.

In one or more of the embodiments described herein, engaging the tubular with the first and second stabilization surfaces changes an angle between a longitudinal axis of the cutter assembly and a longitudinal axis of the tubular.

In one or more of the embodiments described herein, engaging the tubular with the first and second stabilization surfaces centralizes a longitudinal axis of the cutter assembly within the tubular.

In one or more of the embodiments described herein, engaging the tubular with the second stabilization surfaces moves a longitudinal axis of the cutter assembly gravitationally-upward within the tubular.

As will be understood by those skilled in the art, a number of variations and combinations may be made in relation to the disclosed embodiments all without departing from the scope of the invention.

The invention claimed is:

1. A rotatable blade for cutting a tubular, comprising:
a blade body extendable from a retracted position;
a cutting portion on the blade body having:
a trailing cutting structure configured to engage the tubular,
an intermediate cutting structure configured to engage the tubular while the trailing cutting structure engages the tubular,
a leading cutting structure configured to engage an exposed wall thickness of the tubular; and
a wearable coating configured to cushion an impact between the blade and the tubular; and
an integral stabilizer disposed on at least a portion of an outer surface of the blade body.

2. The blade of claim 1, wherein the intermediate cutting structure is disposed on a first leading face of the cutting portion, and the leading cutting structure is disposed on a second leading face of the cutting portion.

3. The blade of claim 1, wherein the trailing cutting structure includes at least one of crushed carbide and an epoxy coating.

4. The blade of claim 1, wherein at least one of the intermediate cutting structure and the leading cutting structure includes a plurality of chip breaker inserts.

5. The blade of claim 1, wherein the cutting portion includes a bottom surface having a bottom taper upwardly from the outer surface of the blade body to the outer surface of the cutting portion.

6. The blade of claim 1, wherein the cutting portion includes an outer surface having an outer taper outwardly from a top of the cutting portion to a bottom of the cutting portion.

7. The blade of claim 6, wherein the cutting portion includes a second outer surface comprising a second outer taper outwardly from the top of the cutting portion to the bottom of the cutting portion, wherein the second outer taper differs from the outer taper.

8. A rotatable blade for cutting a tubular, comprising:
a blade body extendable from a retracted position;
a cutting portion on the blade body having:
a trailing cutting structure configured to engage the tubular,
an intermediate cutting structure configured to engage the tubular while the trailing cutting structure engages the tubular,
a leading cutting structure configured to engage an exposed wall thickness of the tubular; and
a bottom surface having a bottom taper upwardly from the outer surface of the blade body to the outer surface of the cutting portion; and
an integral stabilizer disposed on at least a portion of an outer surface of the blade body.

9. The blade of claim 8, wherein the intermediate cutting structure is disposed on a first leading face of the cutting portion, and the leading cutting structure is disposed on a second leading face of the cutting portion.

10. The blade of claim 8, wherein the cutting portion includes a wearable coating configured to cushion an impact between the blade and the tubular.

11. The blade of claim 8, wherein the cutting portion includes an outer surface having an outer taper outwardly from a top of the cutting portion to a bottom of the cutting portion.

12. The blade of claim 11, wherein the cutting portion includes a second outer surface comprising a second outer taper outwardly from the top of the cutting portion to the bottom of the cutting portion, wherein the second outer taper differs from the outer taper.

13. A rotatable blade for cutting a tubular, comprising:
a blade body extendable from a retracted position; and
a cutting portion on the blade body having:
a first cutting structure configured to laterally cut the tubular,
a second cutting structure configured to laterally cut the tubular,
a third cutting structure configured to axially cut an exposed wall thickness of the tubular, and
wherein the second cutting structure is between the first cutting structure and the third cutting structure, and wherein the first cutting structure is configured to engage the tubular prior to the second cutting structure and the third cutting structure.

14. The rotatable blade of claim 13, further comprising an integral stabilizer disposed on at least a portion of an outer surface of the blade body.

15. The rotatable blade of claim 13, wherein the first, second, and third cutting structures comprise a plurality of cutting elements.

16. The rotatable blade of claim 13, wherein the second cutting structure defines a first cutting face and the third cutting structure defines a second cutting face.

17. A rotatable blade for cutting a tubular, comprising:
a blade body extendable from a retracted position, the blade body having a first side that faces in a direction of the rotation of the blade; and a cutting portion on the first side of the blade body having:

a first cutting structure configured to engage the tubular, a second cutting structure configured to engage the tubular, the second cutting structure forming a first cutting face, a third cutting structure configured to engage the tubular, the third cutting structure forming a second cutting face, and wherein the second cutting face is stepped relative to the first cutting face, and the first cutting structure engages the tubular before the second cutting structure and the third cutting structure.

18. The rotatable blade of claim 17, wherein the third cutting structure forms a portion of the first cutting face.

19. A rotatable blade for cutting a tubular, comprising:

a blade body extendable from a retracted position;

a cutting portion on the blade body having:

a trailing cutting structure configured to engage the tubular, an intermediate cutting structure configured to engage the tubular while the trailing cutting structure engages the tubular, a leading cutting structure configured to engage an exposed wall thickness of the tubular;

an outer surface having an outer taper outwardly from a top of the cutting portion to a bottom of the cutting portion; and an integral stabilizer disposed on at least a portion of an outer surface of the blade body.

20. The blade of claim 19, wherein the intermediate cutting structure is disposed on a first leading face of the cutting portion, and the leading cutting structure is disposed on a second leading face of the cutting portion.

21. The blade of claim 19, wherein the cutting portion includes a wearable coating configured to cushion an impact between the blade and the tubular.

22. The blade of claim 19, wherein the cutting portion includes a second outer surface comprising a second outer taper outwardly from the top of the cutting portion to the bottom of the cutting portion, wherein the second outer taper differs from the outer taper.

* * * * *